US012714907B2

(12) United States Patent
Jones et al.

(10) Patent No.: US 12,714,907 B2
(45) Date of Patent: Aug. 25, 2026

(54) EXERCISE BIKE

(71) Applicant: Coulter Ventures, LLC., Columbus, OH (US)

(72) Inventors: Dylan Jones, Santa Barbara, CA (US); Patrick Burgess, Asheville, NC (US); Matt Dubberley, Santa Barbara, CA (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

(21) Appl. No.: 18/629,368

(22) Filed: Apr. 8, 2024

(65) Prior Publication Data

US 2024/0335699 A1 Oct. 10, 2024

Related U.S. Application Data

(63) Continuation of application No. PCT/US2023/074372, filed on Sep. 15, 2023.

(60) Provisional application No. 63/535,918, filed on Aug. 31, 2023, provisional application No. 63/457,899, filed on Apr. 7, 2023.

(51) Int. Cl.

| | |
|---|---|
| ***A63B 22/06*** | (2006.01) |
| ***A63B 21/00*** | (2006.01) |
| ***A63B 21/008*** | (2006.01) |

(52) U.S. Cl.

CPC .... *A63B 22/0605* (2013.01); *A63B 21/00058* (2013.01); *A63B 21/0085* (2013.01)

(58) Field of Classification Search

CPC ..... A63B 22/0605; A63B 2022/0611; A63B 2022/0635; A63B 21/0085

See application file for complete search history.

(56) References Cited

U.S. PATENT DOCUMENTS

| | | | | |
|---|---|---|---|---|
| D806,223 | S | * | 12/2017 | Allard ..... D23/370 |
| D860,427 | S | * | 9/2019 | Cayton ..... D23/370 |
| D980,929 | S | | 3/2023 | Jones et al. |

(Continued)

FOREIGN PATENT DOCUMENTS

| | | |
|---|---|---|
| CN | 111167066 A | 5/2020 |
| CN | 216788807 U | 6/2022 |

(Continued)

OTHER PUBLICATIONS

Mar. 15, 2024—(WO) ISR and WO—App PCT/US2023/074372.

*Primary Examiner* — Zachary T Moore

(74) *Attorney, Agent, or Firm* — Banner & Witcoff, Ltd.

(57) ABSTRACT

An exercise bike includes a frame, a pedal assembly, and a rotor mounted on the frame and operably connected to the pedal assembly. The rotor includes a hub with a plurality of blades extending radially outward from the hub. A rotor cover is mounted on the frame and at least partially encloses the rotor, and has opposed side portions and a middle portion extending between the side portions. One side portion has an opening, and the rotor cover further has slots extending on opposite sides of the middle portion. The bike also includes a moveable baffle that is moveable to selectively restrict air passage through the opening, and an actuator connected to the moveable baffle and including a handle and two legs extending into the slots. The actuator is moveable by the legs traveling along the slots to adjust the moveable baffle.

28 Claims, 23 Drawing Sheets

(56) References Cited

U.S. PATENT DOCUMENTS

| | | | | |
|---|---|---|---|---|
| 11,719,252 | B2 * | 8/2023 | Lin | H05K 7/20172 416/182 |
| D1,071,283 | S * | 4/2025 | Liang | D26/59 |
| 2014/0221158 | A1 | 8/2014 | Mabey et al. | |
| 2016/0208638 | A1 * | 7/2016 | Chen | A63B 21/22 |
| 2017/0274238 | A1 * | 9/2017 | Chou | A63B 21/0088 |
| 2017/0319889 | A1 | 11/2017 | Cei et al. | |
| 2017/0361153 | A1 | 12/2017 | Machovina et al. | |
| 2018/0256932 | A1 * | 9/2018 | Hsu | A63B 23/03525 |
| 2018/0290015 | A1 | 10/2018 | Xing | |
| 2018/0326257 | A1 | 11/2018 | Jones et al. | |
| 2019/0329092 | A1 * | 10/2019 | Jones | A63B 21/154 |
| 2021/0101042 | A1 | 4/2021 | Donner et al. | |
| 2023/0110565 | A1 | 4/2023 | Jones et al. | |
| 2023/0135018 | A1 | 5/2023 | Tseng | |

FOREIGN PATENT DOCUMENTS

| | | | |
|---|---|---|---|
| CN | 217773118 | U | 11/2022 |
| CN | 218636549 | U | 3/2023 |
| CN | 219167631 | U | 6/2023 |
| CN | 114810631 | B | 7/2023 |
| CN | 219481441 | U | 8/2023 |
| CN | 108825552 | B | 10/2023 |
| CN | 219932518 | U | 10/2023 |
| TW | I810477 | B | 8/2023 |
| WO | 2015093982 | A1 | 6/2015 |

* cited by examiner

EXERCISE BIKE

CROSS REFERENCE TO RELATED APPLICATIONS

This application is a continuation of International Application No. PCT/US2023/074372, filed Sep. 15, 2023, which claims priority to U.S. Provisional Application No. 63/457,899, filed Apr. 7, 2023, and U.S. Provisional Application No. 63/535,918, filed Aug. 31, 2023, which prior applications are incorporated by reference herein in their entireties.

FIELD OF THE INVENTION

This disclosure relates to exercise bikes, and more specifically to exercise bikes having features that provide improved energy efficiency, enhanced feel, and increased durability, among other benefits.

BACKGROUND

Exercise bikes and other exercise equipment that use human exertion to drive rotation of a rotor to provide resistance for exercise purposes are common and known in the art. Such equipment can be provided in a wide variety of configurations, with many different features. However, existing equipment of this type also suffers from many drawbacks, and a need exists for improvements. For example, many existing exercise bikes have structures that do not provide rigid construction, smooth and consistent user effort, or close synchronization between components during use, leading to an overall "feel" that is unsatisfactory for many users. This unsatisfactory "feel" is particularly important in equipment that may be used repeatedly, even daily or more frequently by some users. Additionally, many existing exercise bikes do not provide consistent variable resistance. The present disclosure addresses these and other problems with existing exercise bikes and other exercise equipment.

BRIEF SUMMARY

Aspects of the disclosure relate to an exercise bike that includes a frame configured to rest on a ground surface, a pedal assembly mounted on the frame, and a rotor mounted on the frame and configured for rotation about a rotation axis, the rotor operably connected to the pedal assembly to power rotation of the rotor, where the rotor includes a hub with a plurality of fan blades extending radially outward from the hub. A rotor cover is mounted on the frame and at least partially encloses the rotor, the rotor cover having a first side portion and a second side portion on an opposite side of the rotor from the first side portion, and a middle portion extending between the first and second side portions and circumferentially around at least a portion of the rotor. The first side portion has a first opening, and the rotor cover further has a first slot and a second slot extending around a portion of the rotor cover on opposite sides of the middle portion. The exercise bike also includes a variable resistance assembly including a first moveable baffle that is moveable to selectively restrict air passage through the first opening, and an actuator connected to the first moveable baffle and including a handle configured for gripping by a user to move the moveable baffle, and a first leg and a second leg extending into the first slot and the second slot, respectively, such that the first leg extends through the rotor cover via the first slot and connects to the first moveable baffle. The handle in this configuration extends across the middle portion, and the first and second legs are on opposite sides of the rotor, and the actuator is moveable by the first leg and the second leg traveling along the first slot and the second slot, respectively. The exercise bike may also include an arm assembly configured for powering rotation of the rotor, which may be provided in addition to or in place of the pedal assembly. For example, the pedal assembly may provide power to the rotor by rotational motion, and the arm assembly may provide power by reciprocal motion. A pulley assembly may also be included to transfer power to the rotor from the pedal assembly and/or the arm assembly.

According to one aspect, the rotor has a width measured across the fan blades parallel to the rotation axis, and the actuator extends completely across the width of the rotor.

According to another aspect, the second side portion has a second opening, and the variable resistance assembly includes a second moveable baffle on an opposite side of the rotor as the first moveable baffle. The second moveable baffle is moveable to selectively restrict air passage through the second opening.

According to a further aspect, the variable resistance assembly includes a first fixed baffle positioned adjacent to the first moveable baffle and the first opening. The first fixed baffle has a plurality of first air passages, and the first moveable baffle is moveable and configured to cover a selectable portion of the plurality of first air passages to control airflow through the first air passages, thereby selectively restricting air passage through the first opening. In one aspect, the second side portion has a second opening, and the variable resistance assembly includes a second moveable baffle on an opposite side of the rotor as the first moveable baffle, and a second fixed baffle positioned adjacent to the second moveable baffle and the second opening. In this configuration, the second fixed baffle has a plurality of second air passages, and the second moveable baffle is moveable and configured to cover a selectable portion of the plurality of second air passages to control airflow through the second air passages, thereby selectively restricting air passage through the second opening.

According to yet another aspect, the first moveable baffle has a disc-shaped body with a substantially circular outer profile and a plurality of first air passages, with a gap extending from the outer profile to one of the first air passages, and the first leg of the actuator is connected to the body of the first moveable baffle on both sides of the gap and extends across the gap.

According to a still further aspect, the rotor cover has an upper rear opening in the middle portion, and the first and second slots are on opposite sides of the upper rear opening, such that the handle of the actuator extends across the upper rear opening. In one aspect, the exercise bike also has an air shield connected to the rotor cover and configured for selectively covering a portion of the upper rear opening to control a flow of air displaced by the rotor through the upper rear opening. For example, the air shield may be moveably connected to the rotor cover and moveable between a plurality of positions relative to the upper rear opening to selectively cover a plurality of portions of the upper rear opening to control the flow of air displaced by the rotor through the upper rear opening.

Additional aspects of the disclosure relate to a rotor for an exercise bike, including a hub configured to be rotatably mounted on the exercise bike and a plurality of blades fixed to the hub at a proximal end and extending outward from the hub to a distal end, where each of the plurality of blades has first major surface configured to be a trailing surface in a direction of travel of the blade and a second major surface opposite the first major surface and configured to be a leading surface in a direction of travel of the blade. Each of the plurality of blades includes a first section extending along a longitudinal direction from the proximal end toward the distal end, where the first section has a central portion that is elongated along the longitudinal direction, a second section extending from the first section to the distal end, and a mount connected to the first section and fixed to the hub. The first section has a flat profile, such that the first and second major surfaces are flat at the central portion. The second section has a curved profile along the longitudinal direction, such that the first major surface has a convexly curved profile and the second major surface has a concavely curved profile.

According to one aspect, the first section of each of the blades further has an outer portion that is elongated along the longitudinal direction and offset from the central portion in a direction perpendicular to the longitudinal direction, and a step portion extending from the central portion to the outer portion. The outer portion in this configuration extends from the step portion to a first outer edge of the blade, and the step portion forms angles with the central portion and the outer portion. In one aspect, the central portion, the outer portion, and the step portion extend continuously from the first section through the second section to the distal end of each of the blades. In another aspect, the first section of each of the blades further has a second outer portion that is elongated along the longitudinal direction and offset from the central portion in the direction perpendicular to the longitudinal direction, and a second step portion extending from the central portion to the second outer portion, such that the second outer portion extends from the second step portion to a second outer edge of the blade opposite the first outer edge, and the second step portion forms angles with the central portion and the second outer portion. In this configuration, the central portion, the outer portion, the second outer portion, the step portion, and the second step portion may extend continuously from the first section through the second section to the distal end of each of the blades.

According to another aspect, each of the blades further has a flange extending along the longitudinal direction and extending transverse to the first and second major surfaces along an outer edge of the blade. In one aspect, the flange of each of the blades extends along the outer edge in the first section and terminates short of the second section.

Further aspects of the disclosure relate to an exercise bike including a frame configured to rest on a ground surface, a pedal assembly mounted on the frame, and a rotor mounted on the frame and configured for rotation about a rotation axis, the rotor operably connected to the pedal assembly to power rotation of the rotor, where the rotor includes a hub with a plurality of fan blades extending radially outward from the hub. A rotor cover is mounted on the frame and at least partially encloses the rotor within a chamber defined by the rotor cover, the rotor cover having a first side portion and a second side portion on an opposite side of the rotor from the first side portion, a middle portion extending between the first and second side portions and circumferentially around at least a portion of the rotor, and an upper rear opening to the chamber located in the middle portion. An air shield is connected to an outer side of the rotor cover and positioned outside the chamber, the air shield configured for selectively covering a portion of the upper rear opening to control a flow of air displaced by the rotor through the upper rear opening. The exercise bike may also include an arm assembly configured for powering rotation of the rotor, which may be provided in addition to or in place of the pedal assembly. For example, the pedal assembly may provide power to the rotor by rotational motion, and the arm assembly may provide power by reciprocal motion. A pulley assembly may also be included to transfer power to the rotor from the pedal assembly and/or the arm assembly.

According to one aspect, the air shield is removably connected to the rotor cover and is configured for selectively covering the portion of the upper rear opening when connected to the rotor cover. In one aspect, the rotor cover has a receptacle located adjacent to the upper rear opening, and the air shield is received in the receptacle when removably connected to the rotor cover. In another aspect, the rotor cover and the air shield have complementary magnetic elements to removably connect the air shield to the rotor cover.

According to another aspect, the air shield is moveably connected to the rotor cover and is moveable between a plurality of positions relative to the upper rear opening to selectively cover a plurality of portions of the upper rear opening to control the flow of air displaced by the rotor through the upper rear opening. In one aspect, the rotor cover has first and second channels extending along opposite sides of the upper rear opening, and the air shield has first and second flanges extending outward from opposed edges of the air shield. In this configuration, the first flange is received in the first channel and the second flange is received in the second channel, such that the air shield is configured to be moveable by the first and second flanges traveling along the first and second channels. In another aspect, the air shield is moveable along a path between the plurality of positions, and the rotor cover has a first opening in the first side portion. In this configuration, and the exercise bike further includes a variable resistance assembly including a first moveable baffle that is moveable to selectively restrict air passage through the first opening, and an actuator connected to the moveable baffle and including a handle configured for gripping by a user to move the moveable baffle, where the handle extends across the path of the air shield. In a further aspect, the air shield has a body moveably connected to the rotor cover along opposed edges thereof, and the body is arched circumferentially with respect to the rotor and also arched transverse to a movement path of the air shield.

According to a further aspect, the rotor cover further includes a screen covering the upper rear opening while permitting passage of air therethrough, and the air shield is positioned outside of the screen and adjacent to an outer surface of the screen.

Still further aspects of the disclosure relate to an exercise bike including a frame configured to rest on a ground surface, a pedal assembly mounted on the frame, and a rotor mounted on the frame and configured for rotation about a rotation axis, the rotor operably connected to the pedal assembly to power rotation of the rotor, where the rotor includes a hub with a plurality of fan blades extending radially outward from the hub. A rotor cover is mounted on the frame and at least partially encloses the rotor, the rotor cover having a first opening on a first side of the rotor cover and a second opening on a second side of the rotor cover opposite the first side. The exercise bike also has a variable resistance assembly that includes a first fixed baffle, a first moveable baffle, a second fixed baffle, and a second moveable baffle. The first fixed baffle is positioned adjacent to the first opening and has a plurality of first air passages. The first moveable baffle is moveable to cover a selectable portion of the plurality of first air passages to control airflow through the first air passages, thereby selectively restricting air passage through the first opening. The first moveable baffle has a first disc-shaped body with a substantially circular outer profile, with a first gap extending from the outer profile to one of the first air passages. The second fixed baffle is positioned adjacent to the second opening and has a plurality of second air passages. The second moveable baffle is moveable to cover a selectable portion of the plurality of second air passages to control airflow through the second air passages, thereby selectively restricting air passage through the second opening. The second moveable baffle has a second disc-shaped body with a substantially circular outer profile, with a second gap extending from the outer profile to one of the second air passages. An actuator is connected to the first moveable baffle and the second moveable baffle and configured for manipulation by a user to move the first and second moveable baffles. The actuator is connected to the first moveable baffle on both sides of the first gap and extends across the first gap, and the actuator is connected to the second moveable baffle on both sides of the second gap and extends across the second gap. The exercise bike may also include an arm assembly configured for powering rotation of the rotor, which may be provided in addition to or in place of the pedal assembly. For example, the pedal assembly may provide power to the rotor by rotational motion, and the arm assembly may provide power by reciprocal motion. A pulley assembly may also be included to transfer power to the rotor from the pedal assembly and/or the arm assembly.

According to one aspect, the rotor cover has a first slot and a second slot extending through the rotor cover, and the actuator includes a handle configured for gripping by the user, a first leg extending from the handle through the first slot to connect to the first moveable baffle, and a second leg extending from the handle through the second slot to connect to the second moveable baffle. In one aspect, the rotor cover has a first side portion and a second side portion on an opposite side of the rotor from the first side portion, and a middle portion extending between the first and second side portions and circumferentially around at least a portion of the rotor. In this configuration, the first side portion has a first opening, and the first slot and the second slot extend around a portion of the rotor cover on opposite sides of the middle portion. In another aspect, the rotor cover has an upper rear opening located between the first slot and the second slot, and the handle of the actuator extends across the upper rear opening.

According to another aspect, the first moveable baffle has a plurality of first moveable baffle air passages and a plurality of first blockers located between the plurality of first moveable baffle air passages, and the second moveable baffle has a plurality of second moveable baffle air passages and a plurality of second blockers located between the plurality of second moveable baffle air passages. The first moveable baffle air passages and the second moveable baffle air passages have widths that are narrower near an inner periphery and greater near an outer periphery of the first moveable baffle and the second moveable baffle, respectively.

Yet additional aspects of the disclosure relate to an exercise bike including a frame configured to rest on a ground surface, a power assembly (e.g., a pedal assembly and/or an arm assembly) mounted on the frame, and a rotor mounted on the frame and configured for rotation about a rotation axis, the rotor operably connected to the power assembly to power rotation of the rotor, where the rotor includes a hub with a plurality of fan blades extending radially outward from the hub. The exercise bike further includes a variable resistance assembly according to any aspects disclosed above and/or an air shield according to any aspects disclosed above. A pulley assembly may also be included to transfer power to the rotor from the power assembly.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
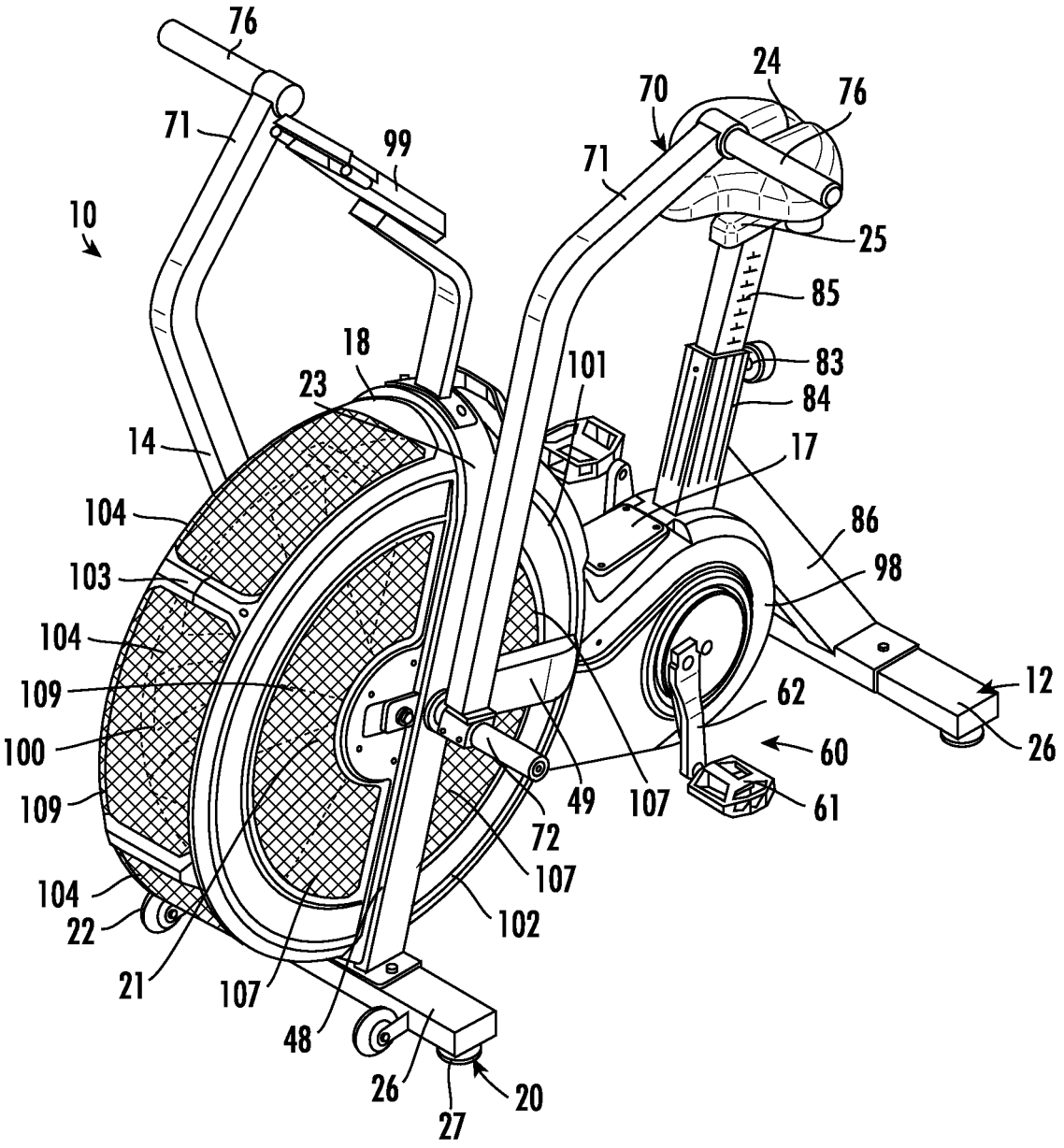
FIG. 1 is a top front perspective view of one embodiment of an exercise bike according to aspects of the disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Referring now to the figures, and initially to FIGS. 1-10, there is shown an embodiment of an exercise bike or stationary bike 10 configured for stationary exercise. The bike 10 generally includes a frame or frame assembly 12, a rotor assembly 14 mounted on the frame 12, a drive assembly 16 mounted on the frame 12 and configured to drive rotation of the rotor assembly 14, a cover 18 configured to at least partially cover the rotor assembly 14, and a variable resistance assembly 110 configured to adjust resistance exerted on the rotor assembly 14 and therefore the resistance to effort experienced by the user. The bike 10 may also include other components, such as a computer system that includes a computer interface 19 as shown in FIGS. 1-2 and 6-7. Embodiments of the bike 10 may include any components and features shown and described in U.S. patent application Ser. No. 16/045,475, filed Jul. 25, 2018, and U.S. Provisional Application No. 62/663,090, filed Apr. 26, 2018, which are both incorporated by reference herein in their entireties.

The frame 12 includes a base 20 configured to rest on the ground or other supporting surface and a plurality of frame members extending upward from the base 20 and supporting the other components of the bike 10. The base 20 in FIGS. 1-2 and 6-7 includes two base members 26, which are configured as cross-members extending laterally with respect to the frame 12, with each base member 26 including one or more ground engaging structures 27 directly connected thereto. The ground engaging structures 27 are configured as adjustable feet in this embodiment. In this configuration, the base members 26 and the ground engaging structures 27 support all other components of the bike 10, including the remainder of the frame 12. The ground engaging structures 27 of the base 20 may further include wheels 22 configured for movement of the bike 10 on the supporting surface. The frame members include rotor support members 23 that support the rotor assembly 14 and components of the drive assembly 16 at the front of the bike 10. The rotor support members 23 in the embodiment of FIGS. 1-10 include axle mounts 21 that hold and/or support the axle 33 of the rotor assembly 14 as described herein. The frame 12 may further include a user support in the form of a seat 24 for the user to sit on during operation of the bike 10, as well as a seat support 83 supporting the seat 24, with adjustment mechanisms 25 for adjusting the vertical and/or horizontal position of the seat 24. A foot plate 17 is connected to the frame 12 in the embodiment of FIGS. 1-10. The frame 12 further has various connections and mounts for connection and mounting of other components of the bike 10, including components of the rotor assembly 14 and/or the drive assembly 16. It is understood that the frame 12 may be differently configured in various other embodiments for desired appearance and/or ergonomics while retaining similar functionality. In other embodiments, the frame 12 and the components and features thereof (including the frame members) may be constructed with similar structural and functional elements having different configurations, including different ornamental appearances.

In one embodiment, the frame 12 includes features that provide a rigid and stable construction. For example, the frame 12 may include thick gauge or heavy-duty frame members in one embodiment, which may allow a stable and rigid construction to be achieved without additional structural reinforcement members. In the embodiment of FIGS. 1-8, the frame 12 includes one or more front ascending frame members 48 that are connected to the front base member 26 and extend continuously upward and rearward from the front base member 26 to form an inverted U-shape over the rotor cover 18, and one or more rear ascending frame members 49 that are connected to the rear base member 26 extend continuously upward and forward from the rear base member 26 to meet the front ascending frame members 48. The rear ascending frame member 49 is connected to the rear base member 26 and extends upward/forward, splitting into two branches near the rotor 30 (forming a "tuning fork" or Y-shape) to connect to the front ascending frame members 48. The ascending frame members 48, 49 in FIGS. 1-8 form a "spine" that supports the rest of the frame 12 and all other components of the bike 10. In this configuration, no portion of the frame 12 extends below the tops of the base members 26, other than the base members 26 themselves and any brackets or connecting structures that directly connect the remainder of the frame 12 (i.e., the ascending frame members 48, 49) to the base members 26. Thus, the lowest portions of the frame 12 are the base members 26 and any frame members 12 connected directly to the base members 26.

The seat support 83 in one embodiment includes a fixed portion 84 that is fixed with respect to the rest of the frame 12 and a moveable or adjustable portion 85 that is moveably connected to the fixed portion 84 to permit adjustment of the seat 24. In the embodiment of FIGS. 1-10, the moveable portion 85 and the seat 24 are vertically adjustable together using a vertical adjustment mechanism 25 on the fixed portion 84, and the moveable portion 85 further includes a horizontal adjustment mechanism 25 for horizontal adjustment of the seat 24 relative to the moveable portion 85. It is understood that the vertical adjustment mechanism 25 may result in some horizontal change in position as well, and that the horizontal adjustment mechanism 25 may likewise result in some vertical change in position. The fixed portion 84 in FIGS. 1-10 is a rectangular tube, and the moveable portion 85 includes a smaller rectangular tube or post that fits inside the fixed portion 84 and is axially moveable with respect to the fixed portion 84. The seat support 83 further has a reinforcing structure to reinforce and provide additional stability to the fixed portion 84, which includes a gusset or support member 86 connected to the rear side of the fixed portion 84 and extending to meet and join with the rear ascending frame member 49 in the embodiment of FIGS. 1-10.

The rotor assembly 14 in the embodiment of FIGS. 1-10 is illustrated in greater detail in FIGS. 2-5 and 7 and includes a rotor 30 in the form of a fan having a hub 31 and a plurality of blades 32 connected to the hub 31 and extending outward from the hub 31 in radial directions. The blades 32 are connected to the hub 31 by connectors 35, which may be in the form of fasteners such as bolts, screws, rivets, etc., in the embodiment of FIGS. 1-10, but additional or alternate connecting structures may be used in other embodiments, such as tabs, slots, or other interlocking mechanical structures, or welding, brazing, soldering, adhesives, or other bonding structures. The hub 31 rotates on an axle or spindle 33, and the rotor assembly 14 further includes an output engagement member 34 that is engaged by the drive assembly 16 to drive rotation of the rotor 30. In the embodiment of FIGS. 1-10, the output engagement member 34 is a sprocket or pulley that is operably connected to the rotor 30 such that the pulley 34 is rotationally fixed with respect to the rotor 30. The pulley 34 is directly connected to the rotor 30 in one embodiment, and may be integrally connected to and/or part of a single piece with the hub 31. In other embodiments, the rotor 30 and the components thereof (including the blades 32) may be constructed with similar structural and functional elements having different configurations, including different ornamental appearances.

Figure 2:
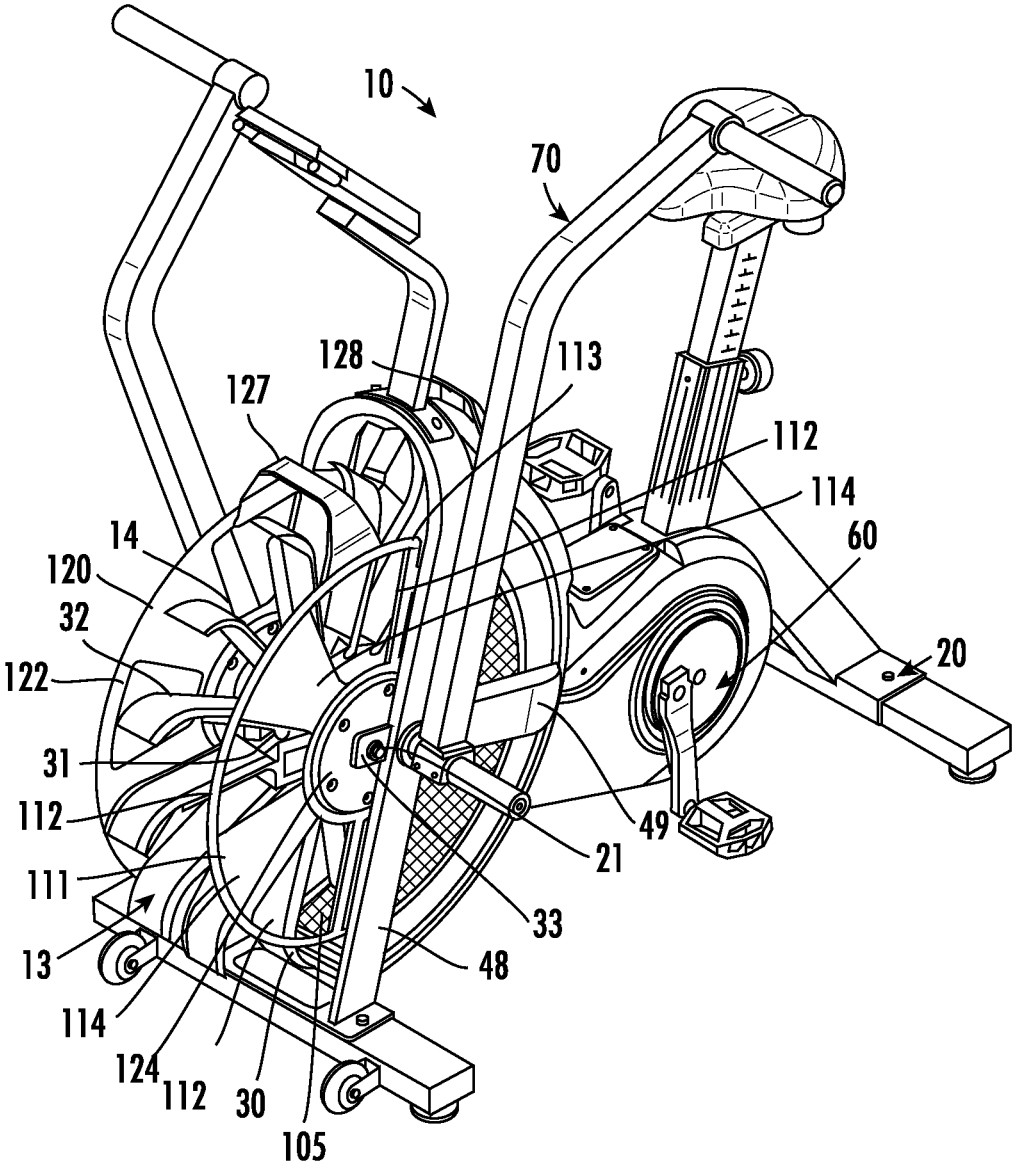
FIG. 2 is a top front perspective view of the exercise bike of FIG. 1 with some components removed to show internal detail.
Figure 3:
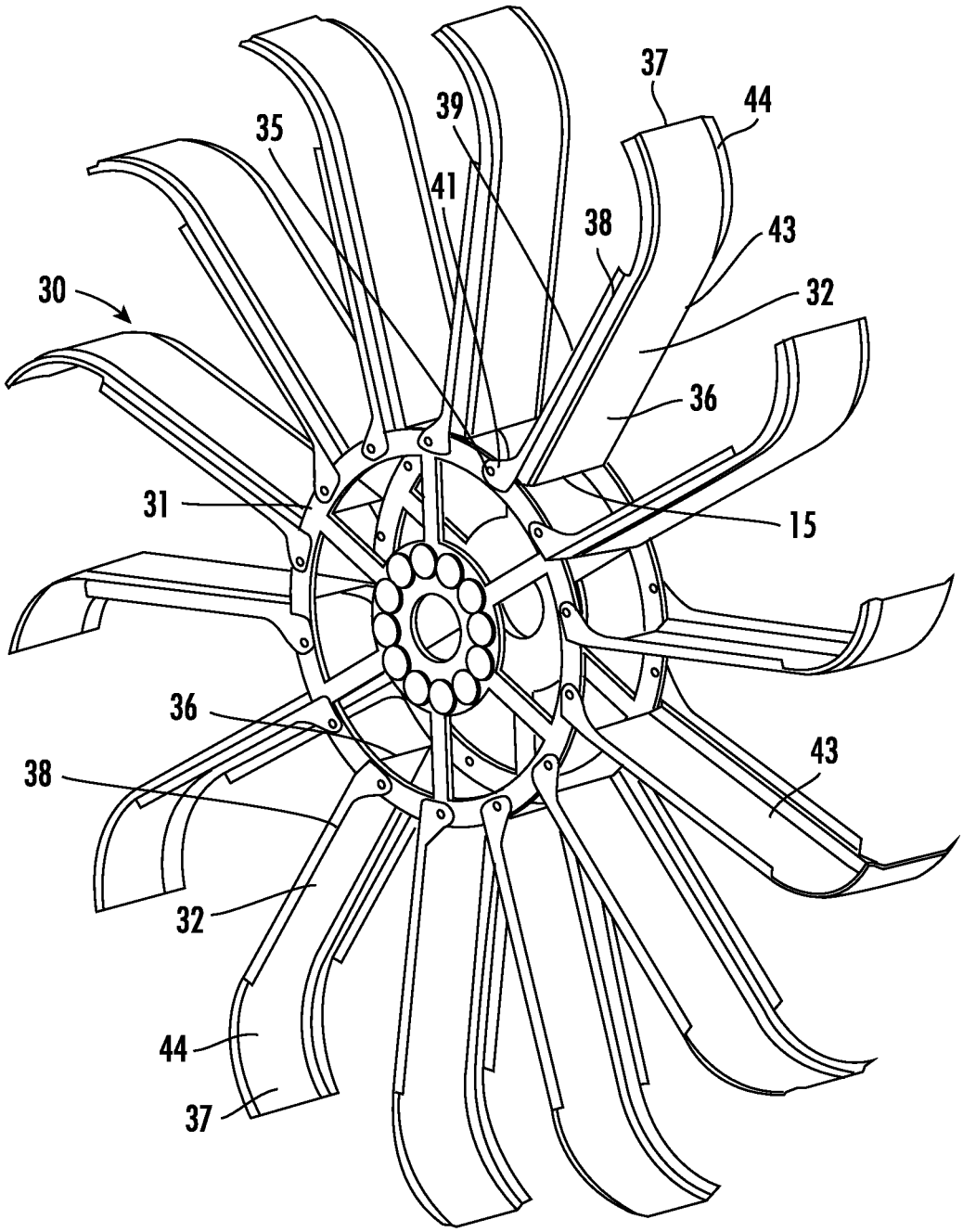
FIG. 3 is a top rear perspective view of a rotor of the exercise bike of FIG. 1.
Figure 4:
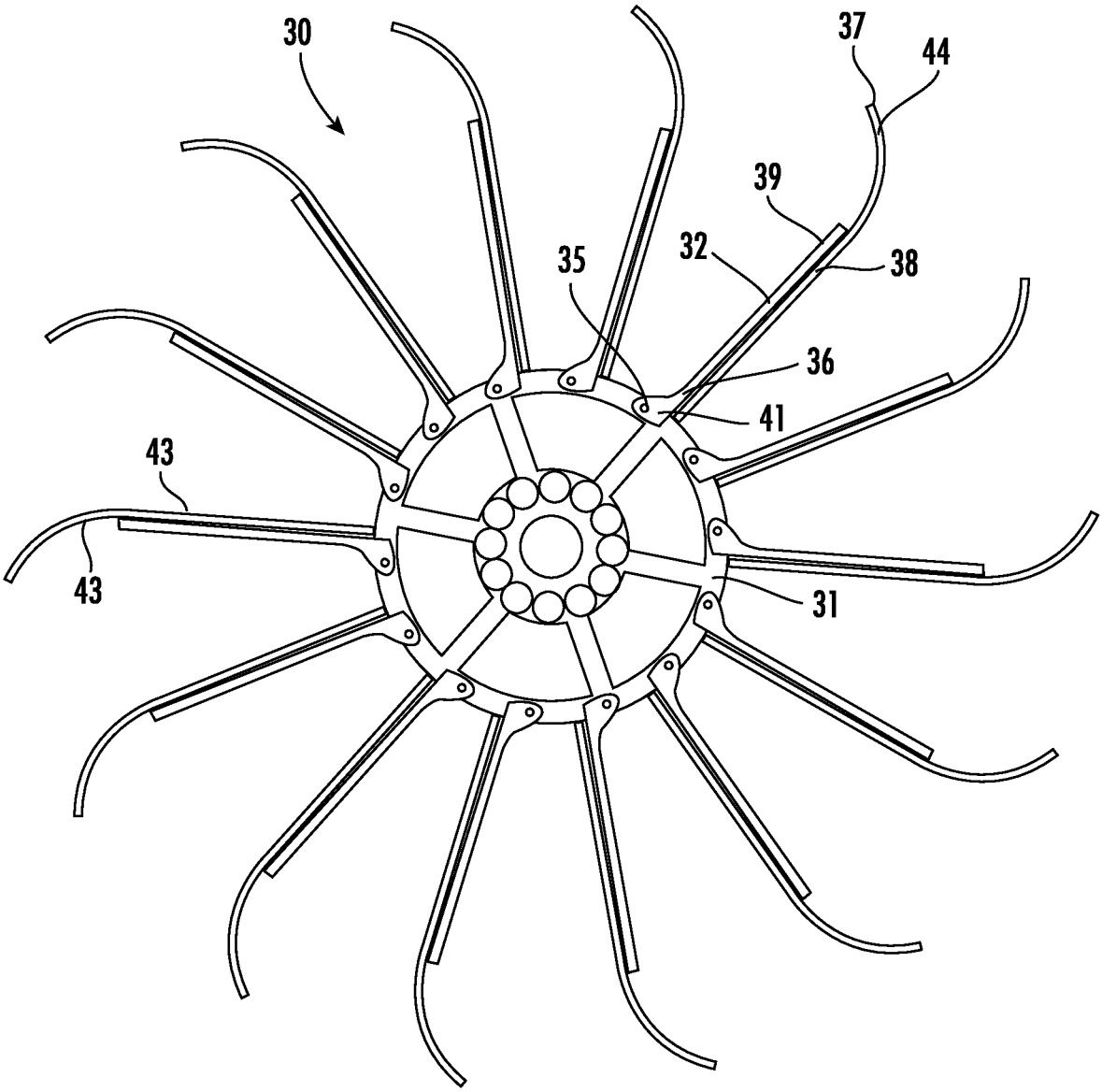
FIG. 4 is a side view of the rotor of FIG. 3.
Figure 5:
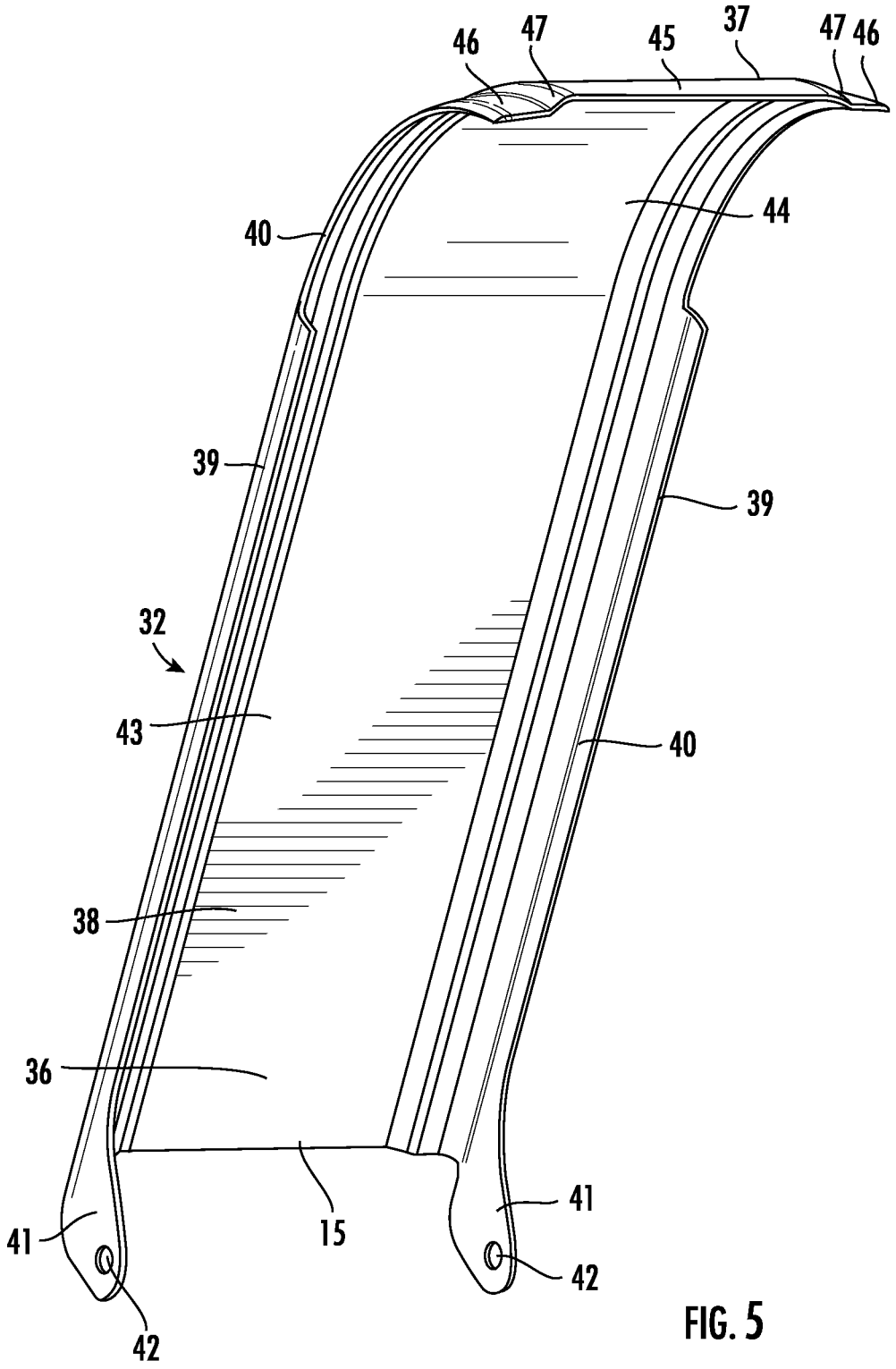
FIG. 5 is a perspective view of a blade of the rotor of FIG. 3.

The blades 32 of the rotor 30 in FIGS. 1-10 are illustrated in greater detail in FIGS. 3-5. Each blade 32 has a proximal end 36 engaging the hub 31 and a distal end or free end 37 distal from the proximal end 36 and from the hub 31, with two opposed sides or edges 40 extending between the ends 36, 37 and opposed top and bottom major surfaces 43. Additionally, each blade 32 has a first section 38 that is elongated and substantially planar and/or flat, and a second section 44 at the distal end 37 that is curved in the direction of travel of the blades 32 around the axis of rotation, with a transition point 87 delineating the two sections 38, 44. In the first section 38, the opposed major surfaces 43 are rectangular and substantially flat, and the edges 40 are straight and linear. In the second section 44, one of the opposed major surfaces 43 (the trailing surface in the intended direction of travel) is convexly curved, and the other major surface 43 (the leading surface) is concavely curved, and both edges 40 are curved. In this embodiment, the first section 38 extends from the proximal end 36 to the second section 44, and the second section 44 extends from the first section 38 to the distal end 37, such that the entire body of each blade 32 is either substantially flat or curved. The direction that each blade 32 extends from the hub 31, i.e., from the proximal end 36 toward the distal end 37, is defined as a longitudinal direction L (see FIG. 5 for reference) for each individual blade 32 as referenced herein, and it is understood that the blades 32 are each elongated along the longitudinal direction L in one embodiment. In a cross-section of the blade 32 of FIGS. 1-10 taken along the longitudinal direction L, the first section 38 has a generally straight, linear shape and the second section 44 has a curved shape. The blades 32 may also be considered to extend radially from the hub 31. The term "elongated" indicates that the respective component (e.g., the first section 38) has a larger dimension in the direction of elongation relative to the two directions perpendicular to the direction of elongation. The curved second sections 44 of the blades 32 create increased turbulence within the rotor chamber 13 as the rotor 30 spins, particularly at higher RPM, which increases resistance to rotation of the rotor 30.

Each blade 32 also has one or more flanges 39 that extend outward from the blade 32 transverse to the major surfaces 43 of the blade 32. In the embodiment of FIGS. 2-5, each blade 32 has two flanges 39 that extend along the opposed sides or edges 40. In other embodiments, one or more of the blades 32 may include a different number or arrangement of flanges 39, for example, by including one or more longitudinally extending flanges 39 located between the two edges 40 in addition to or instead of the flanges 39 extending along the edges 40. In the embodiment of FIGS. 2-5, the flanges 39 extend outwardly from only one major surface 43 of the blade 32 (e.g., the bottom surface), such that the blade 32 has a substantial U-shape or C-shape in cross-section. The flanges 39 in this embodiment extend outward in the intended direction of travel of the blade 32 during rotation. In another embodiment, the flanges 39 may extend outwardly from both major surfaces 43 of the blade 32, such that the blade 32 has a substantial I-shape in cross section. In another embodiment, the flanges 39 may extend outwardly from opposite major surfaces 43 of the blade 32, such that the blade 32 has a substantial S-shape in cross section. In a further embodiment, the flange(s) 39 may be located only on one of the sides 40 of the blade 32. The flanges 39 in FIGS. 2-5 extend the entire length of the first section 38 of the blade 32, from the proximal end 36 to the transition 87 from the first section 38 to the second section 44, but may extend more or less than the entire length of the first section 38 in other embodiments. For example, the flanges 39 may extend continuously into the second section 44 of the blade 32, or the second section 44 may have additional, but separate flanges 39. Additionally, the flanges 39 have a substantially constant height (i.e., distance of transverse extension from the major surface 43 of the blade 32) along their lengths in the embodiment of FIGS. 2-5. In another embodiment, the flanges 39 may have a variable height, e.g., a greater height near the proximal end 36 that tapers continuously to a smaller height toward the distal end 37. Further, each blade 32 has a width (between the edges 40) that is constant from the proximal end 36 to the distal end 37. In another embodiment, the width of each blade 32 may vary from the proximal end 36 to the distal end 37, such as by continuously tapering toward the distal end 37 and/or the first and second sections 38, 44 of the blade 32 having differing widths. The rotor 30 may be considered to have a width that is defined by the maximum widths of the blades 32, which is defined parallel to the axis of rotation R of the rotor 30.

Figure 7:
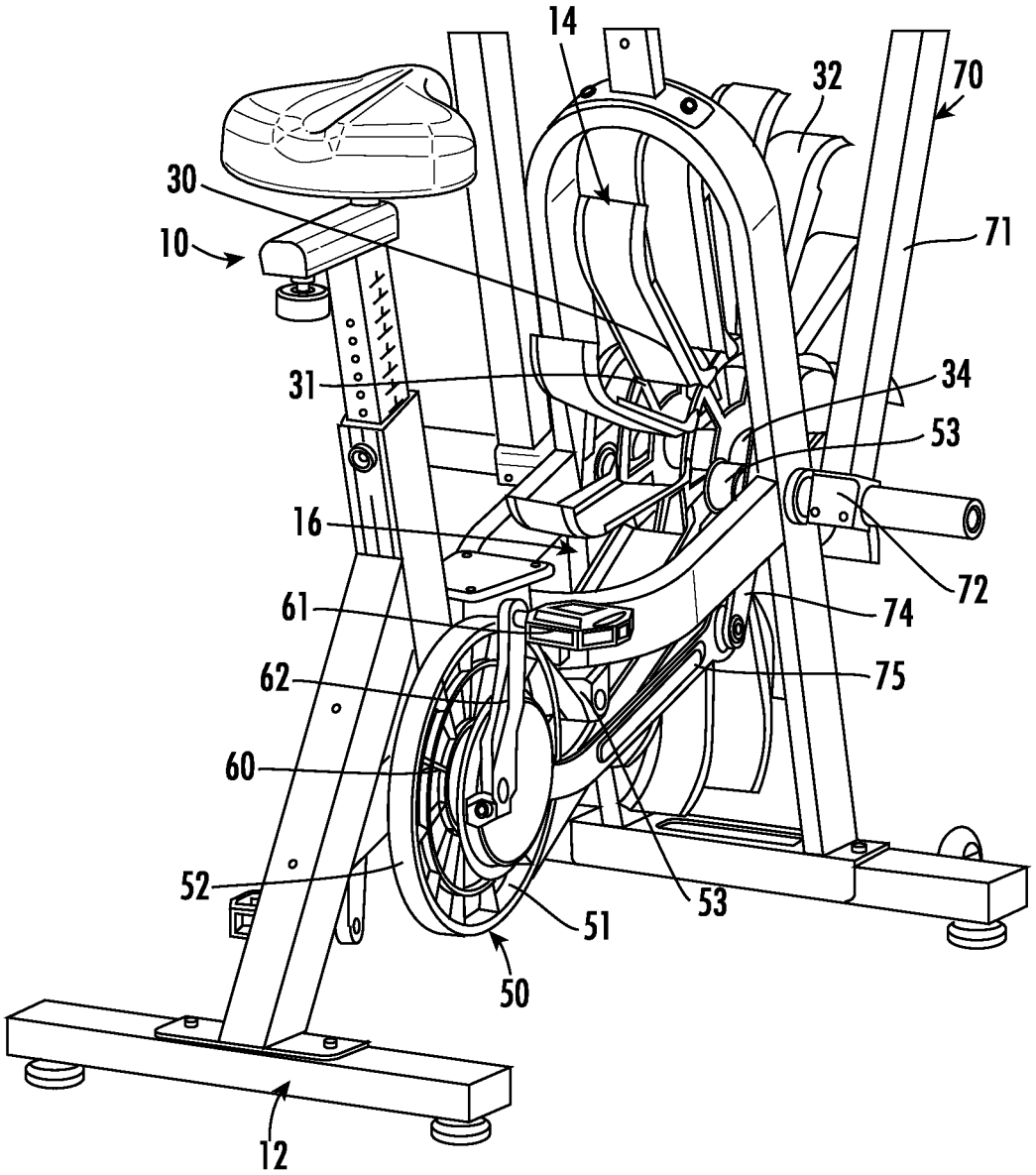
FIG. 7 is a top rear perspective view of a portion of the exercise bike of FIG. 1.

The blades 32 also have mounts 41 extending outward from the first section 38 of the blade 32 at the proximal end 36 to provide a mounting structure for connection to the hub 31. The mounts 41 extend from the proximal end 36 on both sides 40 of the blade 32 in the embodiment of FIGS. 2-5, and each mount 41 has an opening 42 to receive the fasteners 35 for connection to the hub 31. The blade 32 has a proximal edge 15 that extends between the mounts 41 in this embodiment. The fasteners 35 in this embodiment extend through the openings 42 in the mounts 41 and are connected to opposed side surfaces of the hub 31, such as by being received in openings (not shown), which may be threaded. As illustrated in FIGS. 3-4 and 7, the hub 31 has two circular, plate-like end portions 57 with a cylindrical center body 58 having a smaller diameter than the end portions 57, such that the end portions 57 extend radially outward of the center body 58. The end portions 57 may include openings (not shown) configured to receive the fasteners 35 for connection of the blades 32. The mounts 41 are contiguous with the flanges 39 in the embodiment of FIGS. 2-5 and may be considered to be extensions of the flanges 39, which adds strength and support to the mounts 41 for a more solid and stable connection. Additionally, because the flanges 39 extend transversely (e.g., vertically) from the blade 32, the positioning of the mounts 41 at the ends of the flanges 39 allows the connection points with the hub (i.e., openings 42) to be offset from the general plane of the blade 32. The openings 42 in FIGS. 2-5 are offset from the general plane of the blade 32 in the direction of forward rotation of the rotor 30. This offset orientation and arrangement permits each blade 32 to extend radially with respect to the hub 31, while providing clearance for connection of the fasteners 35. In the embodiment of FIGS. 2-5, the blades 32 are all connected and supported only at the mounts 41 at the proximal ends 36, and no other structures engage the blades 32 between the proximal and distal ends 36, 37. In particular, the hub 31 and the connecting structures connecting the blades 32 thereto form the sole structure supporting the blades 32 and directly or indirectly connecting all of the blades 32 together. As described elsewhere herein, other connecting or mounting structures may be used to connect the blades 32 to the hub 31 in other embodiments, and the mounts 41 may be provided with such structures (e.g., integral hooks, tabs, or other connecting structures) and/or configured for connection with such structures. Additionally, in the mounting configuration shown in FIGS. 2-4, the proximal edge 15 of each blade 32 may abut the outer periphery of the two end portions 57 to reinforce the blades 32 against rotation due to force resulting from wind resistance during rotation of the rotor 30. The blades 32 may each be made from a single integral piece, including the first and second sections 38, 44, the flanges 39, and the mounts 41, such as by stamping. In another embodiment, the first and second sections 38, 44 may be formed separately and joined together at the transition point 87, e.g., by welding or other integral joining technique.

The blades 32 in the embodiment of FIGS. 1-10 have a stepped or terraced cross-sectional shape along substantially the entire length thereof. The cross-sectional shape of the blades 32 in FIGS. 1-10 is shown most clearly in FIG. 5. In a stepped or terraced configuration, one or both major surfaces 43 of the blade 32 have a first or upper portion 45 and a second or lower portion 46 that are connected together by one or more shoulders or step portions 47. The upper portion(s) 45, lower portion(s) 46, and step portion(s) 47 all extend longitudinally and are arranged laterally side-by-side in this embodiment. It is understood that "upper" and "lower" as used herein is dependent on orientation, and the present description of the upper and lower portions 45, 46 is made with respect to the orientation of the distal end 37 of the blade 32 shown in FIG. 5. The flanges 39 in this embodiment are positioned at an angle with the upper portion 45 that is approximately 90°. In the embodiment of FIGS. 1-10, the upper and lower portions 45, 46 are generally planar and parallel to each other, and thus, the angle between the flanges 39 and the lower portions 46 are approximately 90° as well. Additionally, the lower portions 46 are parallel and coplanar with each other. The blades 32 in FIGS. 1-10 are thin sections, with opposed major surfaces 43 that are generally mirror images of each other. As seen in FIGS. 1-10, the upper portion 45 is located at the center span or area of the blade 32 and may be considered to be a central portion of the blade elongated along the longitudinal direction L. In this configuration, the two lower portions 46 extend from the ends of the upper portion 45 to the sides 40 of the blade 32 and may be considered to be outer portions of the blade elongated along the longitudinal direction L. The upper and lower portions 45, 46 are offset vertically from each other, and the step portions 47 extend from opposite edges of the upper portion 45 to the two lower portions 46. The step portions 47 extend both outward and downward (relative to the orientation in FIG. 5) from the upper portion 45 to the lower portions 46, and in the configuration illustrated, the step portions 47 form oblique (i.e., non-perpendicular) angles with the upper and lower portions 45, 46. The step portions 47 form angles with the upper portion 45 of 120°-140° in this configuration. In a configuration where the upper and lower portions 45 are parallel to each other, the angle between the lower portions 45 and the step portions 47 are the same as the angle between the step portions 47 and the upper portion 45, i.e., 120°-140°. In another embodiment, the step portions 47 may be angled differently with respect to the upper portion 45 and/or the lower portions 46, including at right angles. The height of the step portions 47 is defined as the difference in height between the surfaces of the upper and lower portions 45, 46, and may therefore be considered to be equivalent to the degree of vertical offset between the upper and lower portions 45, 46. This height is 2-3 mm in one embodiment, and in one embodiment, the height of the step portions 47 is greater than the thickness of the blade 32. As seen in FIG. 5, the upper portion 45, the lower portions 46, and the step portions 47 extend for the entire length of the blade 32, from the proximal end 36 or the proximal edge 15 to the distal end 37. Both the first and second portions 38, 44 have similar stepped configurations in this embodiment, such that the upper portion 45, the lower portions 46, and the step portions 47 are continuous over the entire length of the blade 32, from the proximal end 36 or the proximal edge 15 to the distal end 37. This stepped configuration improves the rigidity and flexural stiffness of the blades 32. In another configuration, the stepped configuration of the blade 32 may extend over only a portion of the length of the blade 32, e.g., in only the first portion 38 or the second portion 44 of the blade 32. In a further configuration, the blade 32 (including part or all of both the first and second portions 38, 44) may have a flat configuration over the entire length thereof, such as in the embodiment of FIGS. 11-19 described herein.

The blades 32 in the embodiment of FIGS. 1-10 have increased weight and rigidity as compared to blades 32 of existing fans or other rotors for exercise bikes, and the flanges 39 provide the blades 32 with increased rigidity and bending stiffness as well as a secure and rigid structure for mounting the blades 32 to the hub 31 as described above. These heavier and sturdier blades 32 have increased inertia, resulting in more smooth and consistent effort throughout the pedal stroke and less vibration, and ultimately better overall feel for the user.

In the embodiment of FIGS. 1-10, the pulley 34 and the rotor 30 (including the hub 31, the blades 32, and any fasteners 35 or other connecting structure) form a unitary rotational body. This unitary rotational body has increased mass and increased moment of inertia (MOI) with respect to the rotational axis, as compared to existing fans or other rotors for exercise bikes in one embodiment, due in part to the construction of the blades 32 described herein. Additionally, the weight/mass of the rotor 30 is more evenly distributed over the diameter of the rotor 30 as compared to many existing rotors, which are perimeter-weighted. The rotor 30 in FIGS. 1-10 has fourteen blades 32, and in another embodiment, a different number of blades 32 may be used.

The drive assembly 16 is operably connected to the rotor assembly 14 and configured to drive rotation of the rotor assembly 14 through mechanical effort exerted by a user. The drive assembly 16 in FIGS. 1-10 includes a pulley assembly or belt and pulley assembly 50 that drives rotation of the rotor assembly 14, a pedal assembly 60 configured to drive the pulley assembly 50 by rotational motion, and an arm assembly 70 configured to drive the pulley assembly 50 by reciprocal motion.

The pulley assembly 50 includes at least an input pulley 51 operably coupled to and configured to receive power input from the pedal assembly 60 and/or the arm assembly 70, an output pulley in the form of the sprocket or pulley 34 configured to transfer power to the rotor 30, and a belt 52 engaging the input pulley 51 and the output pulley 34 to transfer power from the input pulley 51 to the output pulley 34. The input pulley 51 rotates on an axle or spindle, and the output pulley 34 rotates on the axle 33 of the rotor 30. The pulley assembly 50 may also include and one or more tension pulleys 53 located between the input pulley 51 and the output pulley 34. The belt 52 may have another configuration in other embodiments, including being configured as a chain or other flexible loop structure. The pulley assembly 50 in FIGS. 1-10 includes two tension pulleys 53 located near the input pulley 51 and the output pulley 34, respectively. The tension pulleys 53 engage the belt 52 to increase the tension in the belt 52 and to increase the surface area engagement between the belt 52 and the input and output pulleys 51, 34, in order to reduce slippage. The tension pulleys 53 may be considered to divert the path of the belt 52 and create a more circuitous path for the belt 52 so that the belt 52 does not extend directly between the input and output pulleys 51, 34. In this embodiment, exertion by the user on the pedal system 60 and/or the arm system 70 causes rotation of the input pulley 51, which drives rotation of the output pulley 34, thereby driving rotation of the rotor 30. It is understood that the relative diameters of the input pulley 51 and the output pulley 34 may be designed to create a desired mechanical advantage, and that the diameter of the input pulley 51 may be larger than the diameter of the output pulley 34 for that reason. The input pulley 51, the output pulley 34 and the tension pulley(s) 53 in the embodiment of FIGS. 1-10 are made from metal for increased durability, but may be made from other materials in other embodiments.

The pedal assembly 60 as shown in FIGS. 1-10 generally includes two pedals 61 each attached to the end of one of two cranks 62 via spindle mechanisms, with each of the cranks 62 operably connected to the input pulley 51 on opposite sides of the input pulley 51 to drive rotation of the input pulley 51. In the embodiment of FIGS. 1-10, the cranks 62 are connected to the input pulley 51 in a bell crank configuration to create an eccentric revolving mechanism. Cyclical motion of the pedals 61 by user exertion thus drives rotation of the input pulley 51. The pedal assembly 60 may include additional components, such as spindles, axles, and connecting structures to connect the components of the pedal assembly 60 to each other and/or to other components such as the frame 12 or the pulley assembly 50. It is understood that other pedal mechanisms may be used to drive rotation of the input pulley 51 in other embodiments.

Figure 20:
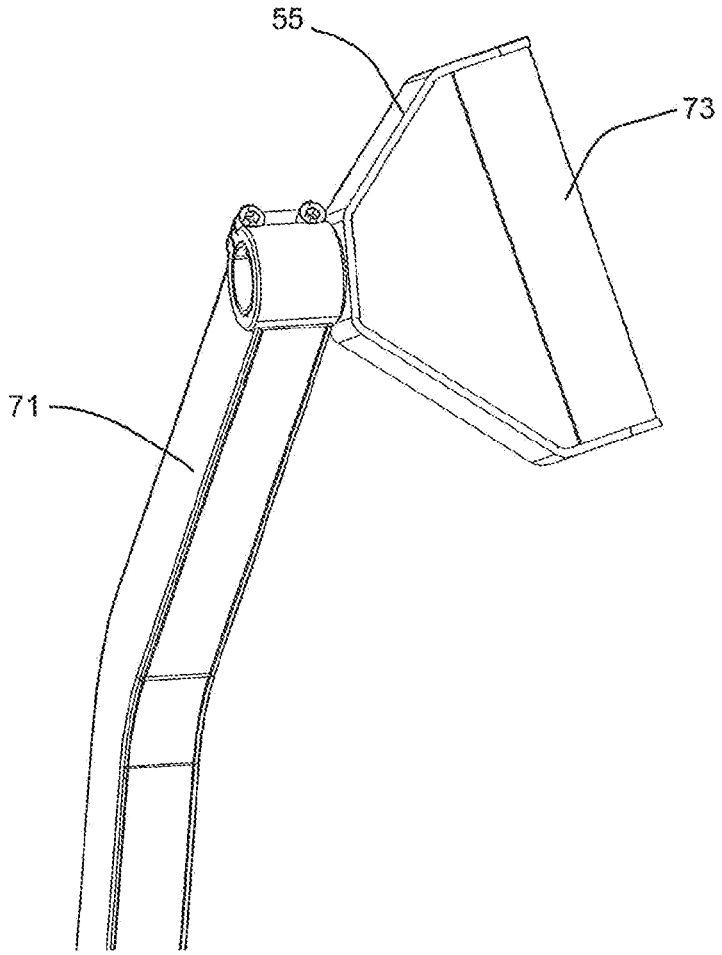
FIG. 20 is a perspective view of another embodiment of a grip usable with the exercise bikes of FIGS. 1-19.

The arm assembly 70 of the embodiment in FIGS. 1-10 is shown best in FIGS. 1-2 and 6-7, and generally includes two arms 71 each connected to an axle 72 to form a pivot point, with each of the axles 72 connected to a lever arm 74, and each of the lever arms 74 connected to a linkage or connecting rod 75 that is operably connected to the pulley assembly 50 and the pedal assembly 60. Each of the arms 71 is an elongated member with a grip 76 that may extend transversely to the arm 71. The arms 71 are connected to the axles 72 and are configured to pivot forward and backward in an oscillating motion, and the user can use the grips 76 to push and pull the arms 71 in this oscillating motion. The grips 76 as shown in FIGS. 1-2 extend perpendicular to the arms 71, but may be configured at oblique (i.e., non-perpendicular) angles to the arms 71 in other embodiments. For example, the grips 76 may extend outwardly and rearwardly (i.e., toward the seat 24) at oblique angles to the arms 71 in one embodiment, which may improve ergonomics. As another example, FIG. 20 illustrates another embodiment of a grip 76 that may be used with any embodiments disclosed herein, which includes a vertical or generally vertical handle 73 and a bracket 55 connecting the handle 73 to the arm 71. Further, the grips 76 shown in FIGS. 1-10 and the grip 76 shown in FIG. 20 are fixed with respect to the arms 71, but may additionally or alternately be connected to the arms 71 in a manner so as to be freely rotatable or pivotable about their axes of elongation.

In the embodiment of FIGS. 1-10, the proximal ends of the lever arms 74 are rotationally fixed with respect to the ends of the arms 71, such as by the arms 71 and the lever arms 74 both being rotationally fixed with respect to the respective axles 72. In this configuration, the lever arms 74 move with the same pivoting and oscillating motion as the arms 71. The distal ends of the lever arms 74 are connected to the linkages 75, such that oscillating movement of the arms 71 and the lever arms 74 results in forward and backward reciprocating motion of the linkages 75. Each of the linkages 75 is connected to an orbital connection at the input pulley 51 and is also freely rotatable with respect to the orbital connection. In this configuration, the reciprocating movement of the linkages 75 is driven by the orbital movement of the orbital connection that is driven by rotation of the input pulley 51 through mechanisms described herein. Accordingly, the user can exert force to drive rotation of the input pulley 51 through rotational exertion on the pedals 61 and/or reciprocal or oscillating exertion on the arms 71. The structures connecting the ends of each linkage 75 in FIGS. 1-10 are in the form of apertures that receive other structures therethrough, e.g., bearings, axles, spindles, etc. The linkages 75 in the embodiment of FIGS. 1-10 have a slight curvature in the vertical direction when installed in the intended positions.

In another embodiment, the pulley assembly 50 of FIGS. 1-10 may be incorporated into an exercise bike that does not have an arm assembly 70, or into other types of exercise equipment that utilize one or more pulley assemblies with or without a fan or other type of rotor assembly. Likewise, the arm assembly 70 of FIGS. 1-10 may be incorporated into an exercise bike that uses a different type of pulley assembly 50 or does not use a pulley assembly, or into other types of exercise equipment that utilize pivoting arms to drive motion.

In one embodiment, the bike 10 may have a computer system connected to various components of the bike 10 to monitor and/or collect data regarding the operation of the bike 10, as well as to make calculations based on such data. For example, such a computer system may include a rotational sensor to sense rotation speed of the rotor 30, as well as a computer memory for storing data gathered by the rotational sensor and a computer processor for making calculations based on such data, e.g., to calculate virtual distance traveled or calories burned. In one embodiment, the computer system for each individual bike 10 may be calibrated to the power input requirements of that bike 10 (determined through testing and/or calculation), so that calculated calorie expenditure data has increased accuracy. The bike 10 in FIGS. 1-10 includes an interface 19 that is positioned to be viewed and/or manipulated by a user and may include visual output, audio output, and/or buttons or other input device(s) for manipulation.

The bike 10 in FIGS. 1-10 further includes various covers and similar components to guard and/or conceal moving parts of the bike 10. For example, the bike 10 includes a rotor cover 18 covering the rotor 30 to protect against contacting the rotor 30 during rotation. The rotor cover 18 in this embodiment is a plastic enclosure with multiple defined openings permitting air passage, that protects the rotor 30 while permitting air displaced by the rotor 30 to flow freely through the rotor cover 18. The configuration of the rotor cover 18 in this embodiment includes a front part 100 that forms approximately the front half of the cover 18 and upper and lower rear parts 101, 102 that form upper and lower rear quarters of the cover 18. Each of the three parts 100, 101, 102 of the cover 18 in this embodiment is formed of two pieces joined together along a central seam 103, such as by fasteners or other connecting structures. The front part 100 is connected to the frame 12 along the front surfaces of the front ascending members 48, the upper rear part 101 is connected to the frame 12 along the rear surfaces of the front ascending members 48 and the top surface of the rear ascending member 49, and the lower rear part 102 is connected to the frame 12 along the rear surfaces of the front ascending members 48 and the bottom surface of the rear ascending member 49 in the embodiment of FIGS. 1-10.

Figure 22:
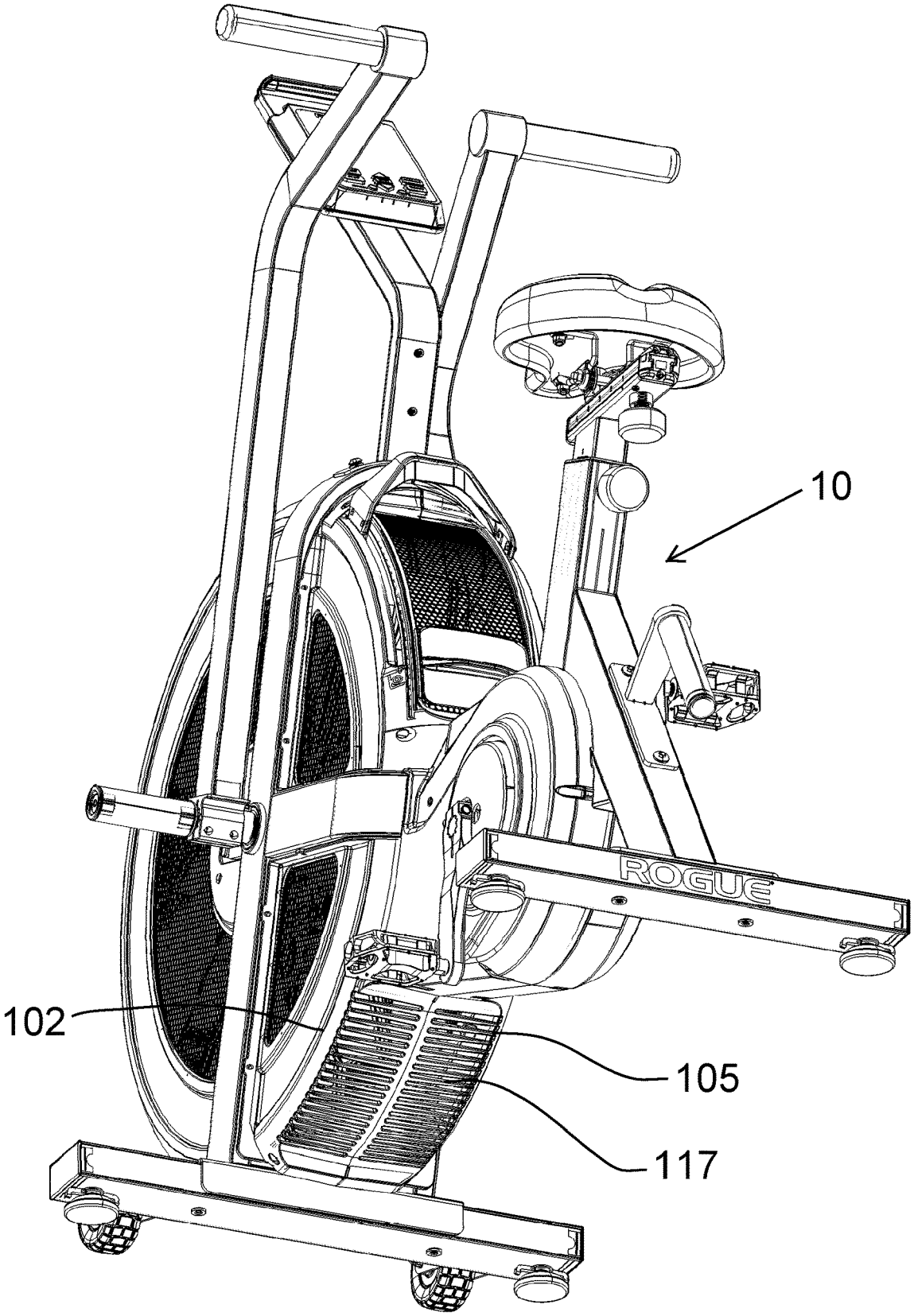
FIG. 22 is a bottom rear perspective view of another embodiment of an exercise bike according to aspects of the disclosure.

The plurality of openings defined by the rotor cover 18 in FIGS. 1-10 includes three front openings 104 defined by the front cover part 100, a lower rear opening 105 defined by the lower rear cover part 102, an upper rear opening 106 defined by the upper rear cover part 101, and a plurality of first side openings 107 and second side openings 108 defined on opposite sides of the rotor 30 by the front and rear cover parts 100, 101, 102. Each of the openings has a screen 109 connected to the cover 18 around the opening, to protect against ingress of large objects that could disrupt or damage the rotor 30 and to protect users against injury by the rotor 30. The cover parts 100, 101, 102 and the screens 109 combine to define a rotor chamber 13 that contains the rotor 30 and some associated structures. In another embodiment, such as shown in FIG. 22, one or more of the openings may be covered by a different structure, such as a vent 117. In the embodiment of FIG. 22, the lower rear opening 105 is covered by a molded plastic vent 117 that is more easily removable than a screen 109, to facilitate servicing the bike 10. The embodiment of FIG. 22 is otherwise identical to the embodiment of FIGS. 1-10. In this configuration, the airflow through the rotor chamber 13 enters through the side openings 107, 108 and exits through the front and rear openings 104, 105, 106. The assembled rotor cover 18 in the embodiment of FIGS. 1-10 has opposed side portions 115 having the side openings 107, 108 defined therein and a middle portion 116 extending between the side portions 115 and having the front and rear openings 104, 105, 106 defined therein. The side portions 115 in this embodiment are generally disc-shaped and radially oriented with respect to the rotation axis R of the rotor 30, and the middle portion 116 is generally circumferential with respect to the rotor 30 and extends circumferentially around at least a portion of the rotor 30.

Figure 6:
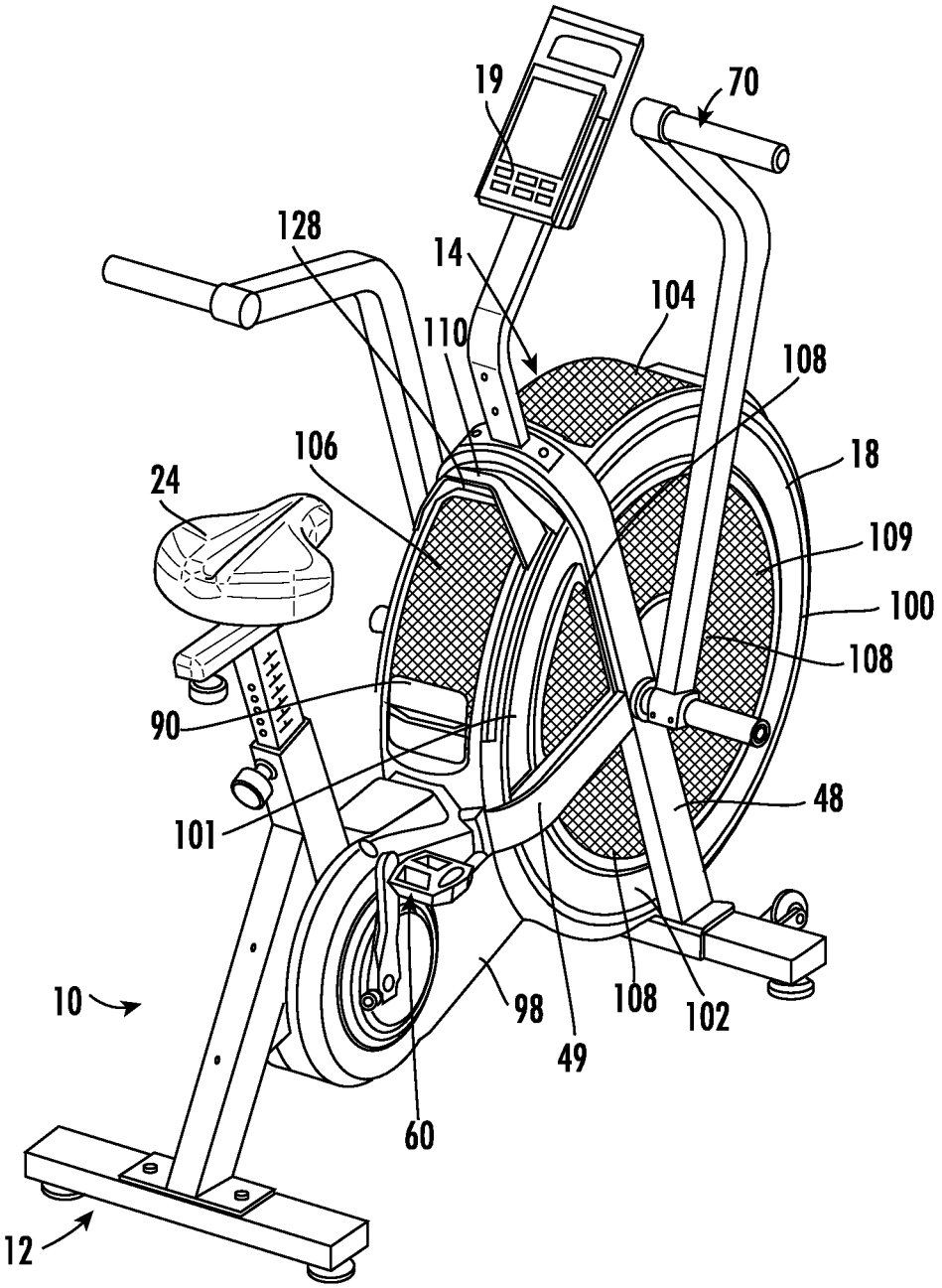
FIG. 6 is a top rear perspective view of the exercise bike of FIG. 1.
Figure 8:
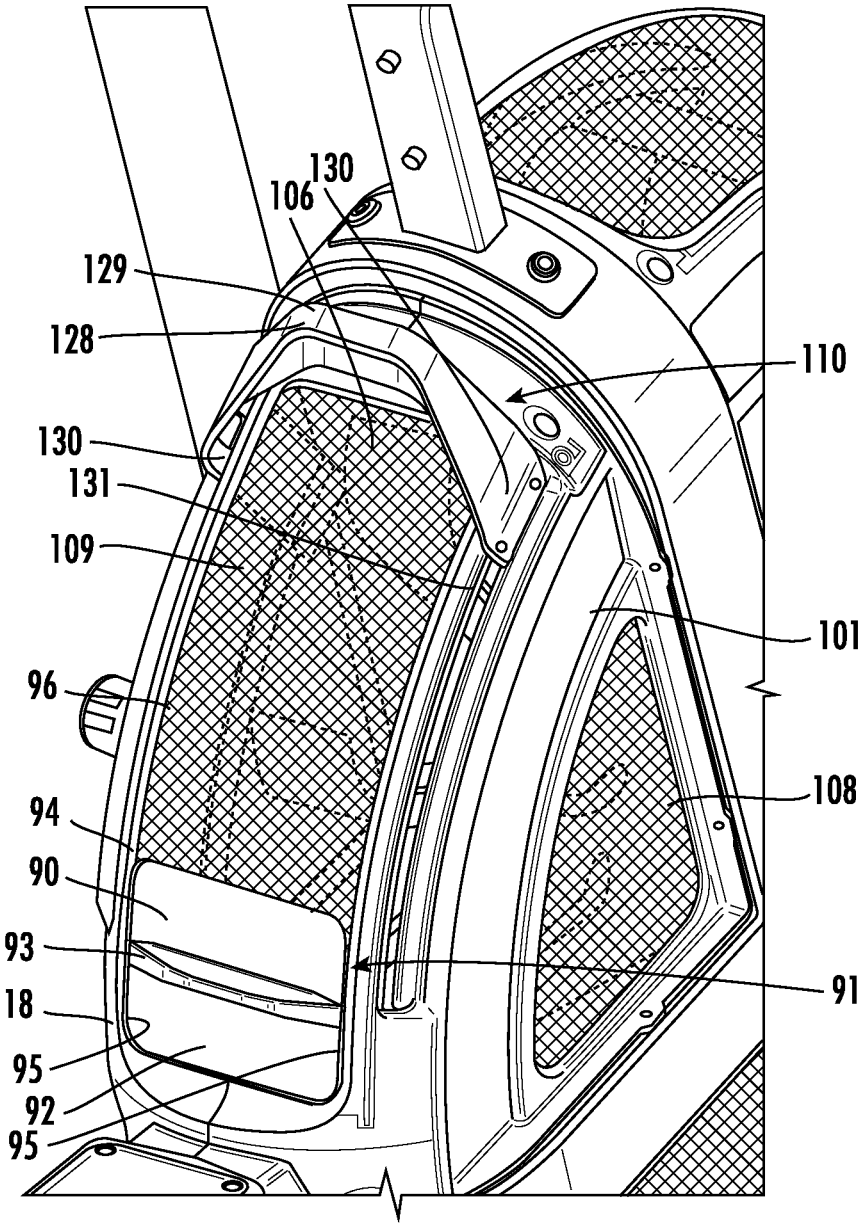
FIG. 8 is a magnified top rear perspective view of a portion of the exercise bike of FIG. 1.
Figure 9A:
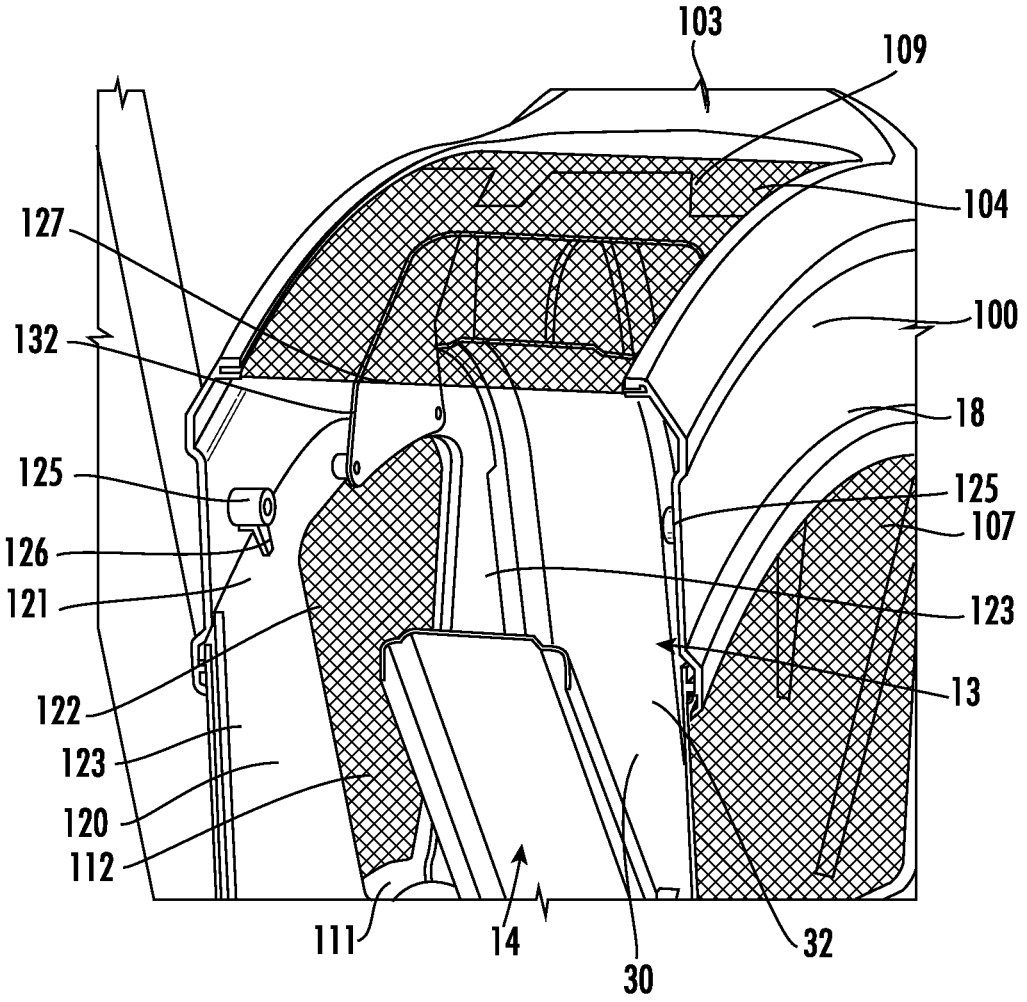
FIGS. 9A and 9B are partial cross-section views of the exercise bike of FIG. 1.
Figure 9B:
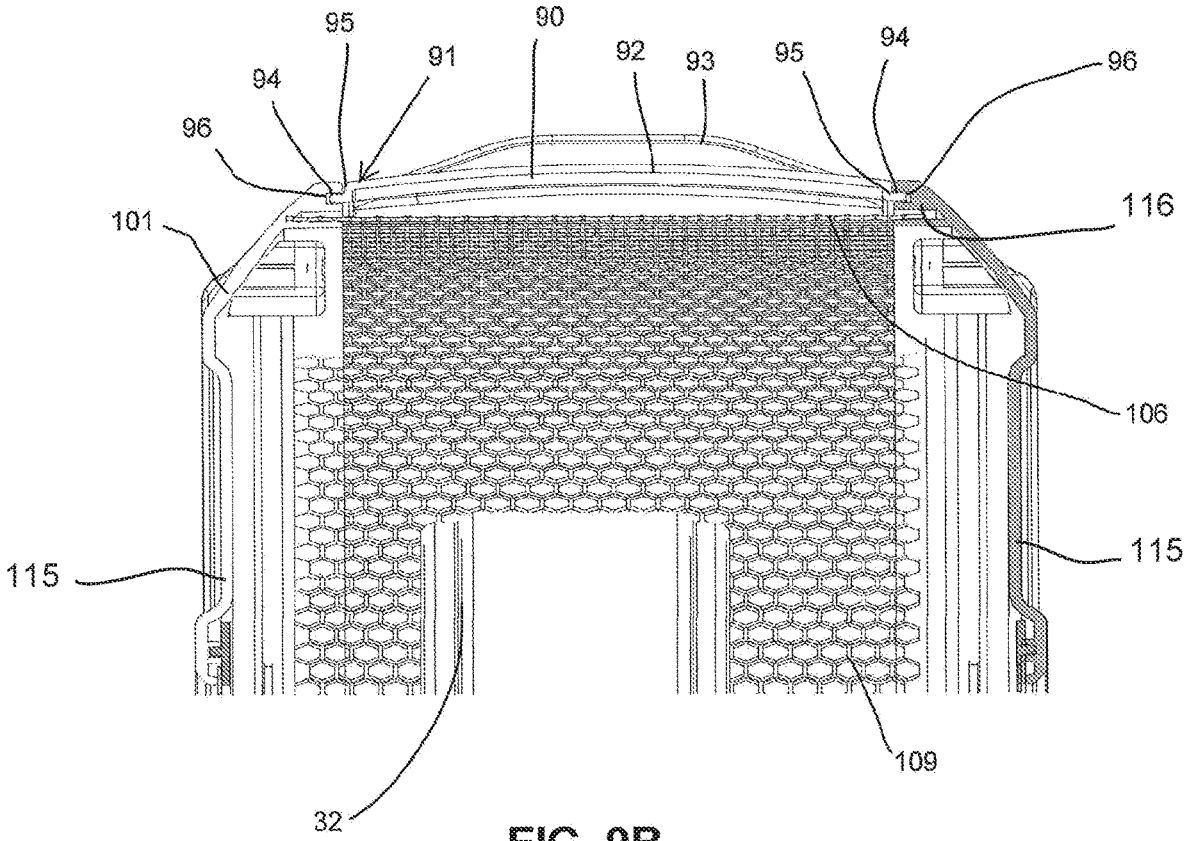

As shown in FIGS. 6, 8, and 9, the bike 10 may further include an air shield 90 connected to the rotor cover 18 that is positioned to selectively cover a portion of the upper rear opening 106 to control air flow through the upper rear opening 106, e.g., to prevent air displaced by the rotor 30 from blowing into the face of the user, or to permit such air flow, as desired. The air shield 90 in this embodiment is moveably connected to the rotor cover 18 and adjustable by user manipulation by sliding along a track 91 between a plurality of positions relative to the upper rear opening 106, to cover a plurality of different portions of the upper rear opening 106. The track 91 in this embodiment extends along the outer side of the rotor cover 18, and the air shield 90 is positioned and connected to the rotor cover 18 entirely on the outer side of the rotor cover 18, such that no portion of the air shield 90 extends into the rotor chamber 13. The air shield 90 generally has a track engaging structure that engages the track 91 to permit movement of the air shield 90 along the track 91, which structure may be complementary with the shape of the track 91. In the embodiment shown in FIGS. 8-9B, the air shield 90 has a body 92 in the form of a slightly arched plate, with a handle 93 on one side for user engagement, and flanges 94 on opposite edges 95 of the body 92. The track 91 in this embodiment is formed by a pair of channels 96 in the upper rear part 101 of the rotor cover 18, located on opposite sides of the upper rear opening 106 and opposite sides of the middle portion 116. The flanges 94 are received in the channels 96 to permit the air shield 90 to slide along the channels 96 to a desired position. The channels 96 in this embodiment are slightly curved or arched along the curvilinear outer periphery of the rotor cover 18, and the flanges 94 are also curved to match the curvature of the channels 96. Accordingly, in the embodiment of FIGS. 8-9B, the body 92 of the air shield 90 is arched circumferentially with respect to the rotor and also arched transverse to the movement path of the air shield (see FIG. 9B). As shown in FIGS. 8-9B, the channels 96 are positioned on the outer side of the screen 109 of the upper rear opening 106, such that the air shield 90 slides over the outer side of the screen 109 and is positioned outside the rotor chamber 13. In this position, the air shield 90 is more easily accessible for maintenance and presents fewer issues with interference with other components within the rotor chamber 13, such as the components of the variable resistance assembly 110. In one embodiment, the movement of the air shield 90 may affect the resistance experienced by the rotor 30, and ultimately the user, by as much as 12% within the normal operation range of 50-110 RPM. In another embodiment, the movement of the air shield 90 may have a smaller effect, or even a negligible effect, on the resistance of the rotor 30.

Figure 21:
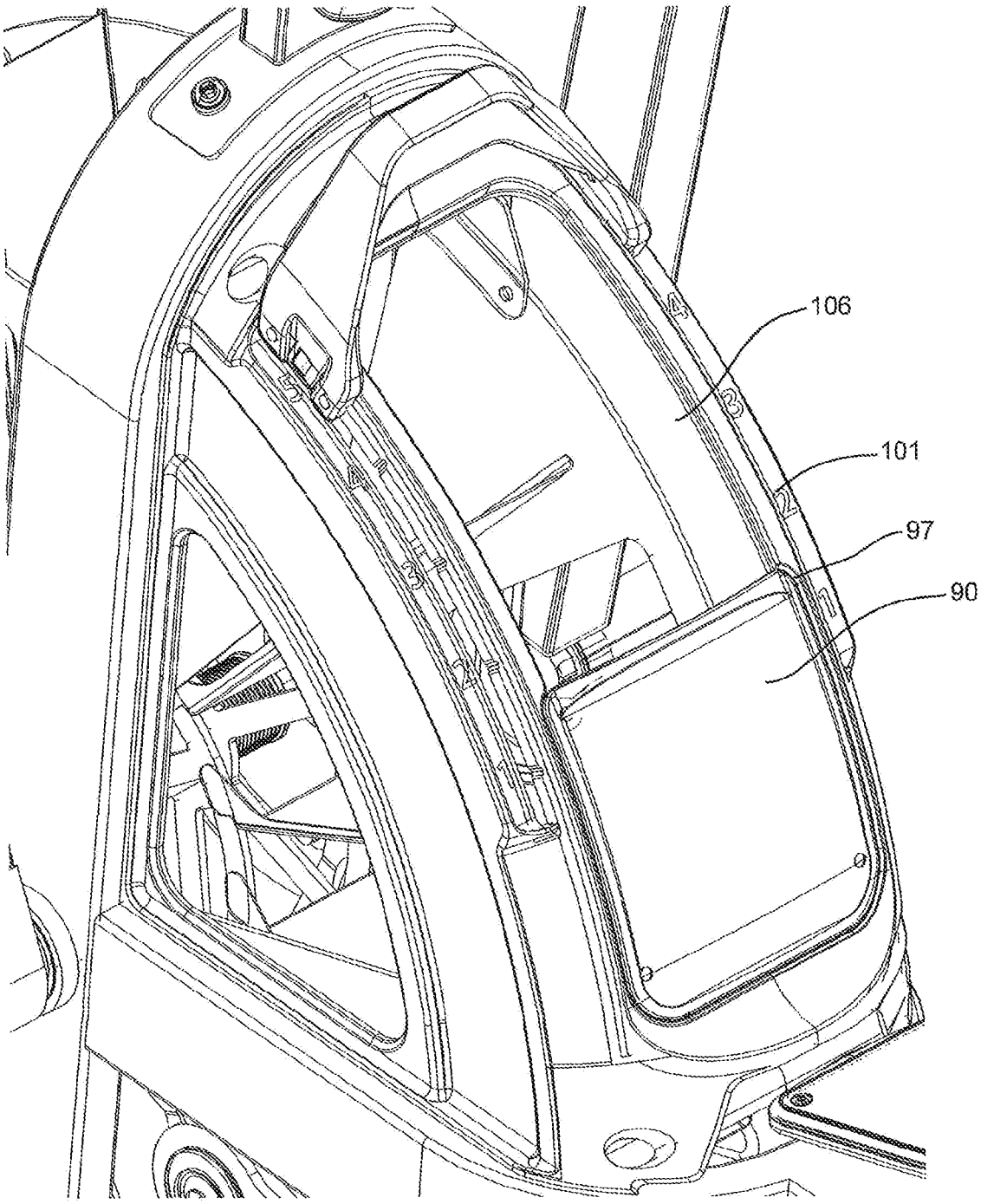
FIG. 21 is a top rear perspective view of a portion of another embodiment of an exercise bike according to aspects of the disclosure, including another embodiment of a wind blocker usable with the exercise bikes of FIGS. 1-19.

FIG. 21 illustrates another embodiment of an air shield 90 that is usable with any embodiment of a bike 10 disclosed herein. In the embodiment of FIG. 21, the air shield 90 is removably positioned within a receptacle 97 within the upper rear rotor cover part 101, such that the air shield 90 is positioned to cover a portion of the upper rear opening 106. The receptacle 97 is located such that the air shield 90 is positioned over the outer side of the screen 109 and is outside the rotor chamber 13, facilitating removal of the air shield 90 as desired. The receptacle 97 in this embodiment is positioned on the outer side of the rotor cover 18, and the air shield 90 is positioned and connected to the rotor cover 18 entirely on the outer side of the rotor cover 18, such that no portion of the air shield 90 extends into the rotor chamber 13. The air shield 90 and/or the rotor cover 18 may include structures for removably retaining the air shield 90 in the receptacle 97. One example of such a retaining structure is complementary magnetic elements in the air shield 90 and the rotor cover 18 that retain the air shield 90 in place by magnetic attraction. Other examples of retaining structures include interlocking tabs, releasable mechanical structures, fasteners, etc. In another embodiment, the air shield 90 may be removably engaged with the rotor cover 18 without a defined receptacle, such as by use of various registration structures or simply surface-to-surface contact, and retaining structures may be used to strengthen this connection.

The bike 10 may also include additional cover panels and structures to cover other components, and in particular, to cover certain moving parts of the pulley assembly 50 and/or the pedal assembly 60. For example, the bike 10 may include cover panels 98 to cover the input pulley 51 and other portions of the pulley assembly 50, as well as the linkages 75, other moving components, and some portions of the frame 12. The cover panels 98 are formed of two pieces joined at a seam 103 in the embodiment of FIGS. 1-10, similar to the rotor cover 18. Additionally, the cover panels 98 may be integral and/or contiguous with portions of the rotor cover 18 in one embodiment. For example, in the embodiment of FIGS. 1-10, the lower rear part 102 of the rotor cover 18 and the cover panels 98 are formed of a contiguous and integral structure, such that two cover pieces each form half of the lower rear part 102 and half of the cover panels 98. The foot plate 17 is connected to the frame 12 and includes a mount (not shown) that extends through the cover panels 98 in this embodiment.

The bike 10 in FIGS. 1-10 includes a variable resistance assembly 110 that adjusts resistance experienced by the user by controlling airflow through the rotor chamber 13, thereby adjusting the air resistance encountered by the rotor 30 during rotation. The variable resistance assembly 110 in this embodiment includes at least one fixed baffle 111 defining a plurality of air passages 112 and at least one moveable baffle 120 configured to cover a selectable portion of the plurality of passages 112 to control airflow through the passages 112. The fixed baffle(s) 111 and the moveable baffle(s) 120 are all positioned within the rotor chamber 13 in the embodiment of FIGS. 1-10. In the embodiment of FIGS. 1-10, the variable resistance assembly 110 includes two fixed baffles 111 on opposite sides of the rotor 30, with one of the fixed baffles 111 positioned adjacent to and partially blocking the first side openings 107 and the other of the two fixed baffles 111 positioned adjacent to and partially blocking the second side openings 108. It is understood that FIGS. 1-10 illustrate only a single moveable baffle 120, but in one embodiment, the variable resistance assembly 110 may include an additional moveable baffle 120 on the opposite side of the rotor 30, connected and positioned in a similar relation to the adjacent fixed baffle 111, as in the embodiment shown in FIG. 16. Thus, in this configuration, the variable resistance assembly controls airflow through the rotor chamber 13 by selectively restricting air flow through the first and second side openings 108. The passages 112 in each of the fixed baffles 111 are smaller in total area than the collective area of the respective first and/or second side openings 107, 108, such that the sizes of the passages 112 in the fixed baffle 111 controls the maximum air flow through the rotor chamber 13. Each fixed baffle 111 has a frame 113 fixedly connected to the inner surface of the rotor cover 18, with passages 112 defined therethrough and blockers 114 positioned between the passages 112 to limit the sizes of the passages 112. The fixed baffles 111 in the embodiment of FIGS. 1-10 are fixed to the front part 100 and the upper and lower rear parts 101, 102 of the rotor cover 18 and partially block and restrict the first and second side openings 107, 108 defined in the front and rear parts 100, 101, 102. Each fixed baffle 111 in this embodiment is formed of multiple separate pieces, and in one configuration, each fixed baffle 111 has a first portion fixed to the front part 100, a second portion fixed to the upper rear part 101, and a third portion fixed to the lower rear part 102. In an alternate embodiment, a separate fixed baffle 111 may not be used, and the air passages 112 may be defined by the openings in the rotor cover 18. The fixed baffle 111 may therefore be integral with and/or defined by the rotor cover 18 in this configuration.

Figure 10:
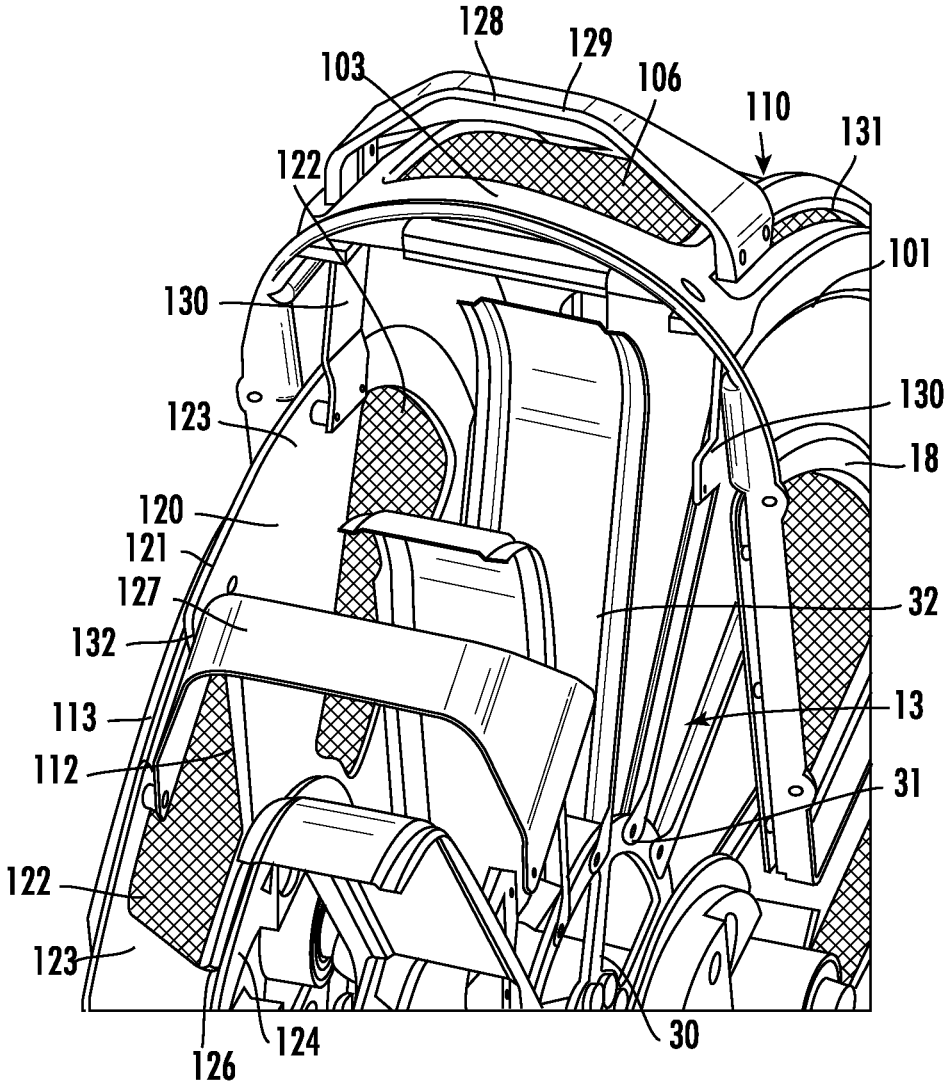
FIG. 10 is a top front perspective view of a portion of the exercise bike of FIG. 1, with some components removed to show internal detail.
Figure 11:
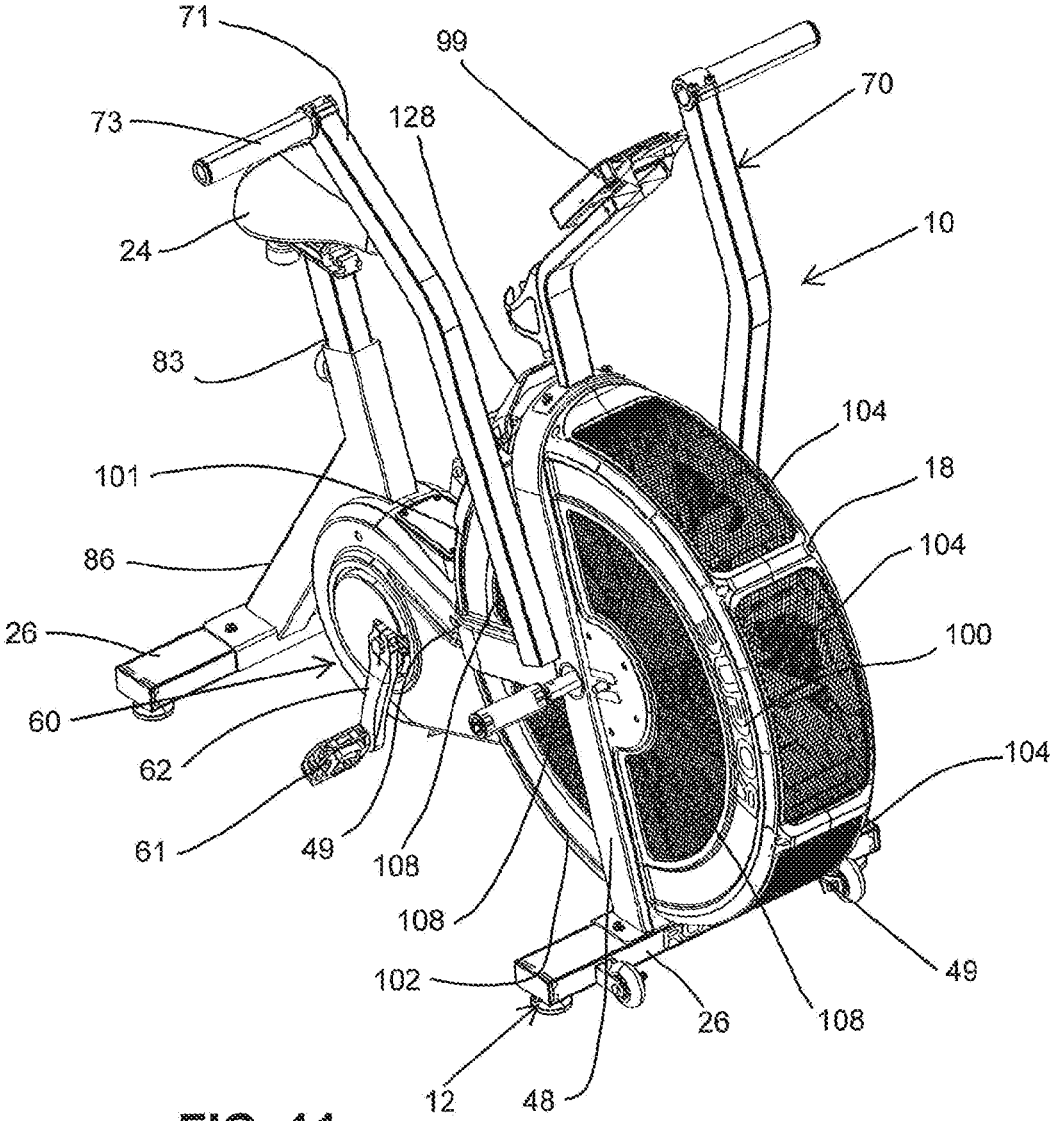
FIG. 11 is a top front perspective view of another embodiment of an exercise bike according to aspects of the disclosure.
Figure 12:
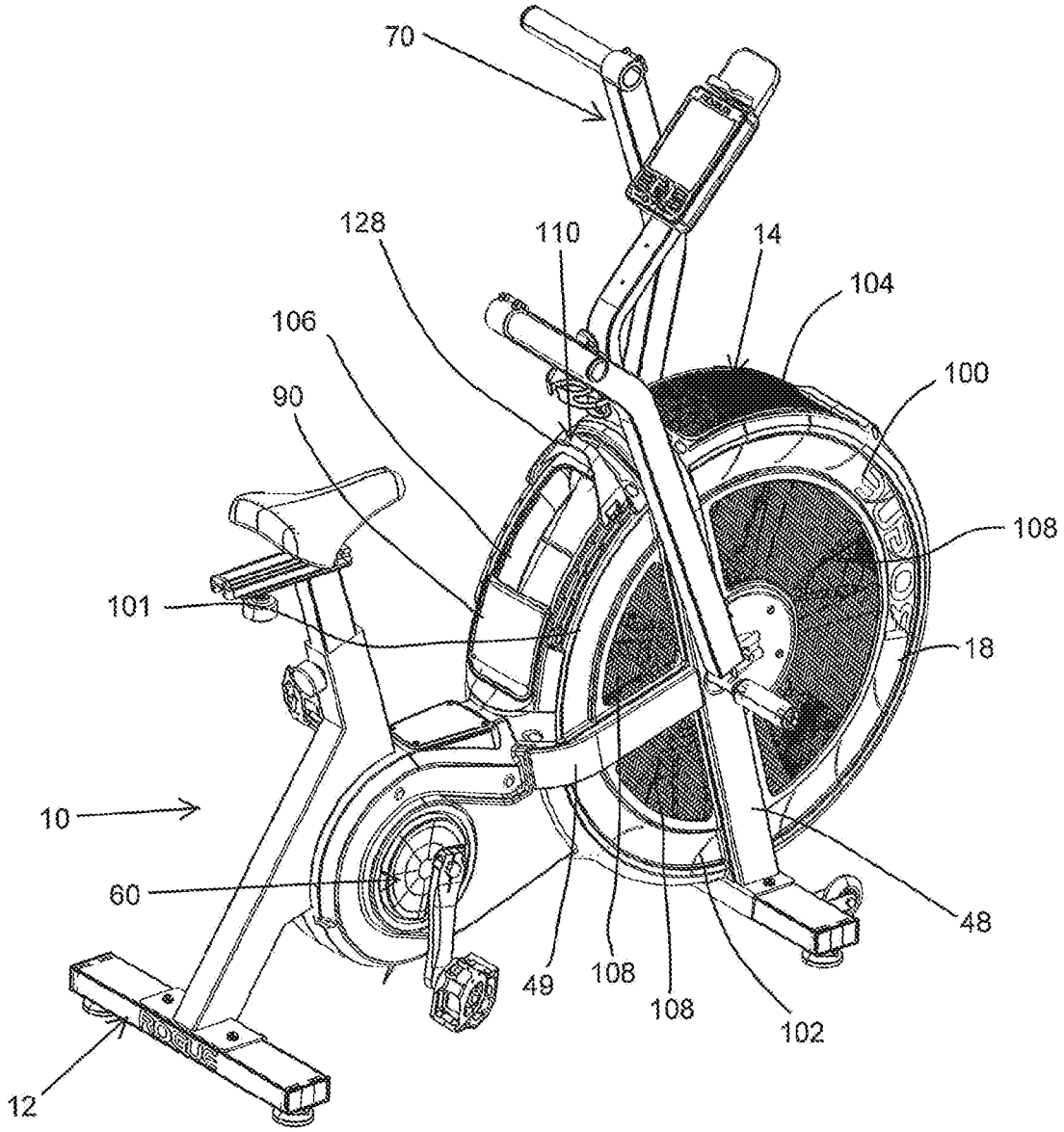
FIG. 12 is a top rear perspective view of the exercise bike of FIG. 11.
Figure 13:
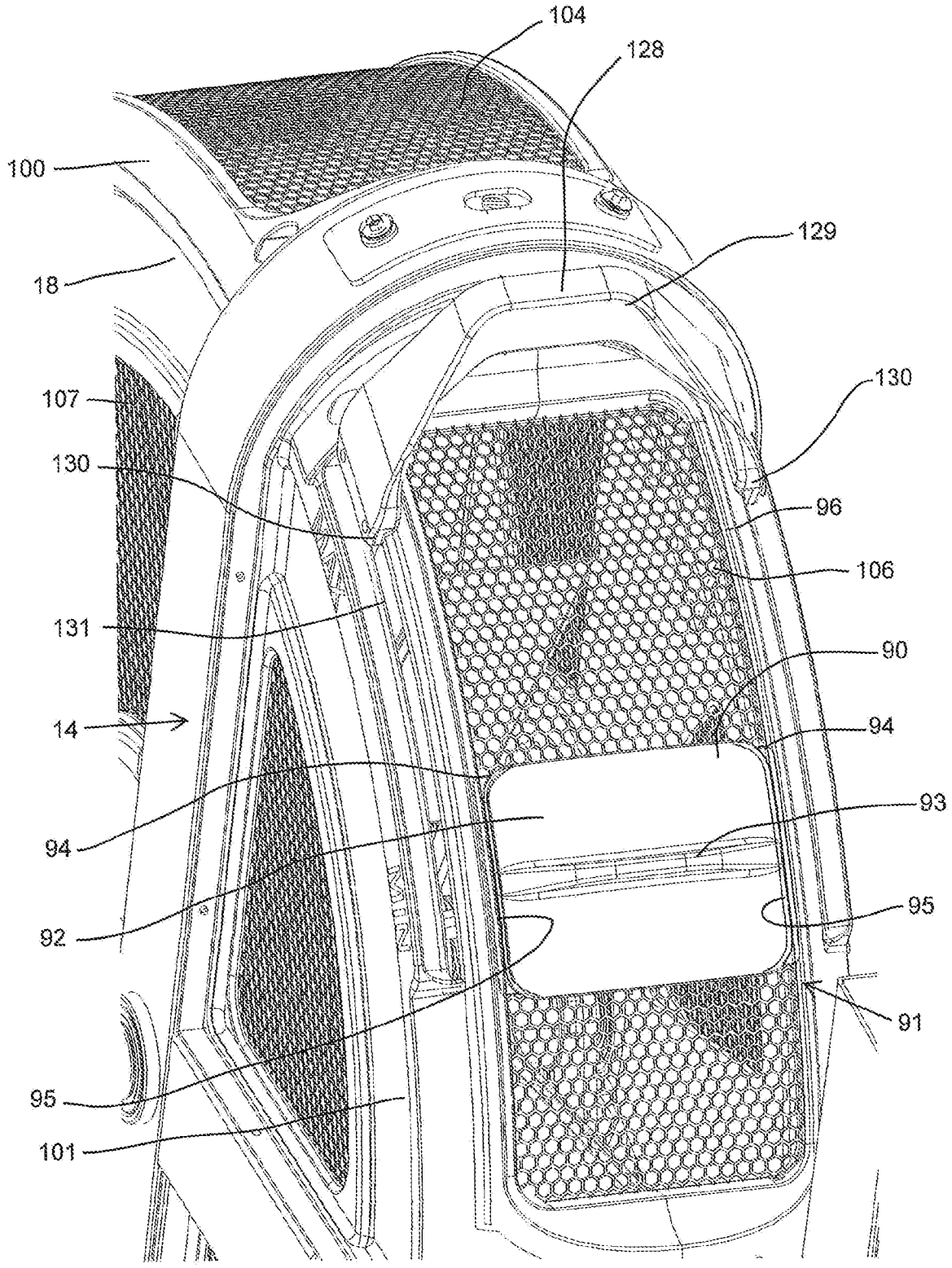
FIG. 13 is a magnified top rear perspective view of a portion of the exercise bike of FIG. 11.
Figure 14:
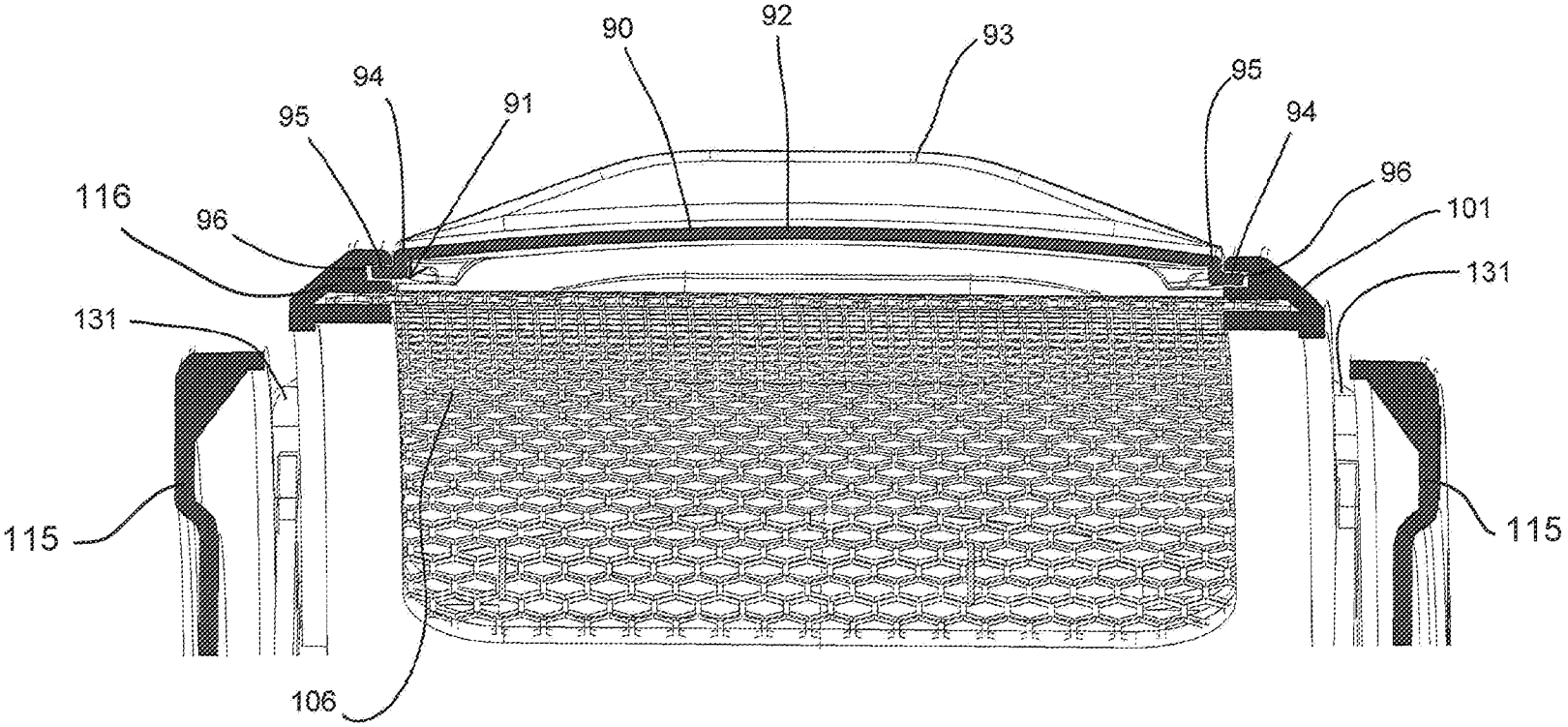
FIG. 14 is a partial cross-section view taken along lines 14-14 of FIG. 12.
Figure 15:
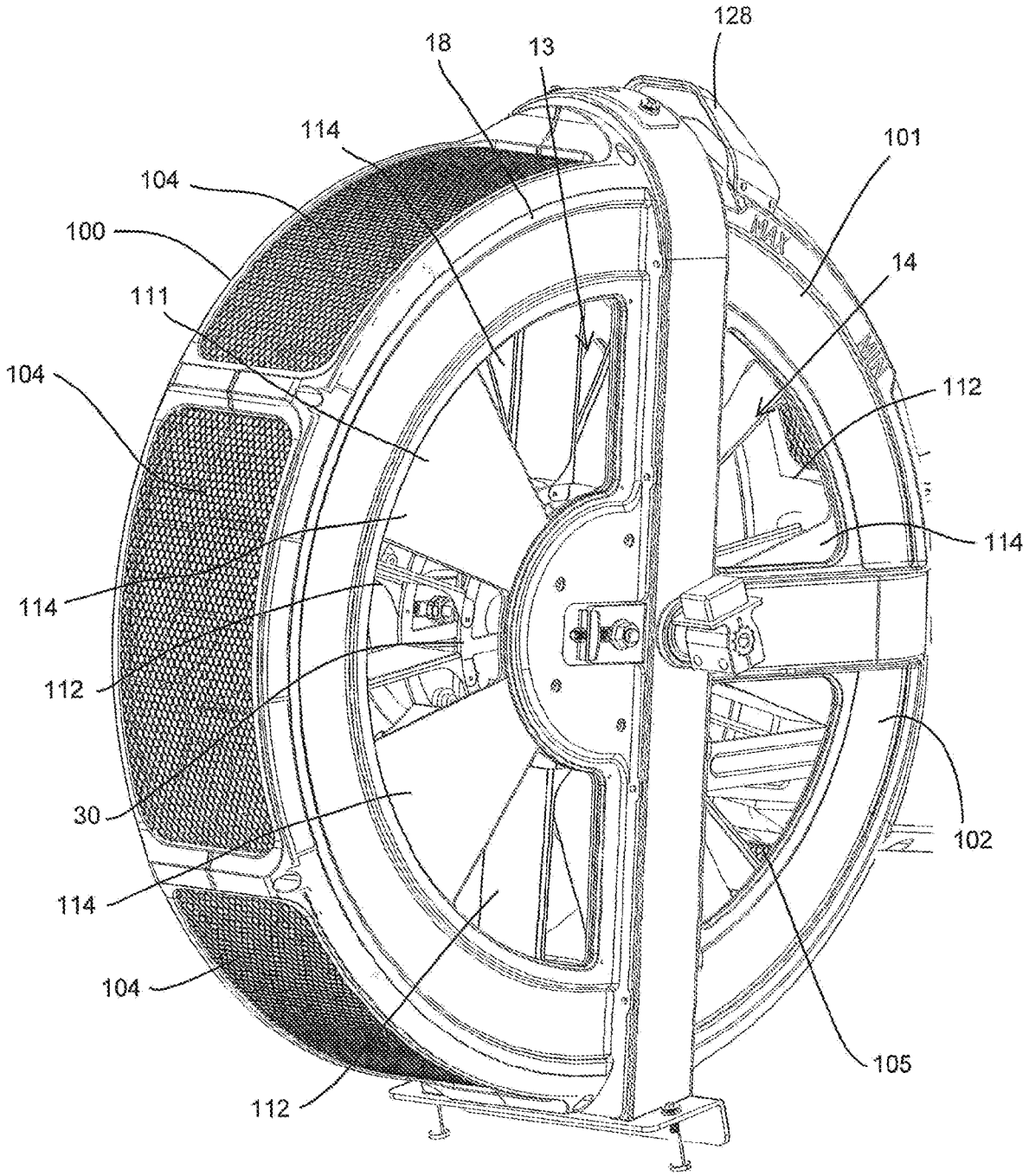
FIG. 15 is a top front perspective view of a portion of the exercise bike of FIG. 11, with some components removed to show internal detail.
Figure 16:
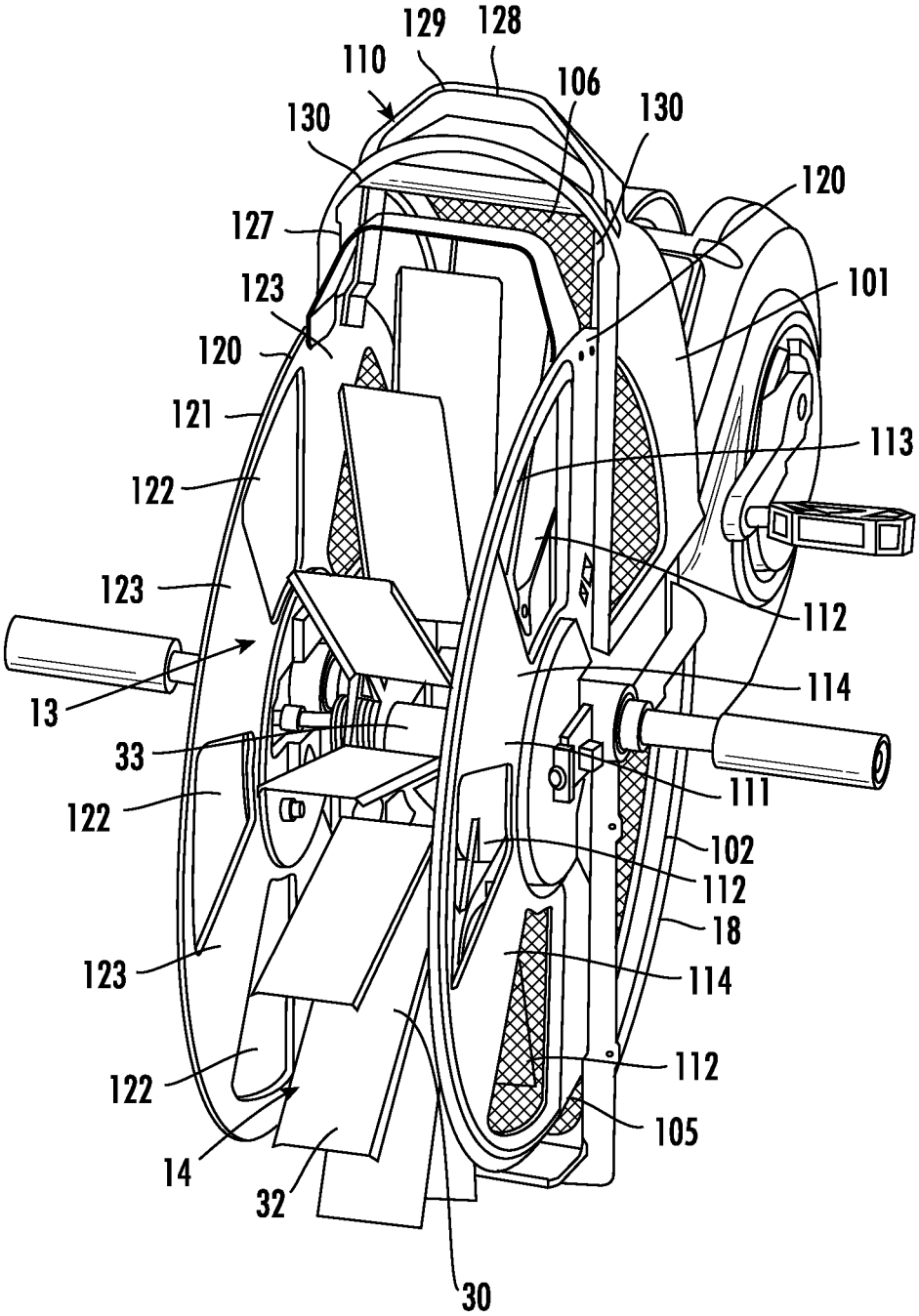
FIG. 16 is a top front perspective view of a portion of the exercise bike of FIG. 11, with some components removed to show internal detail.
Figure 17:
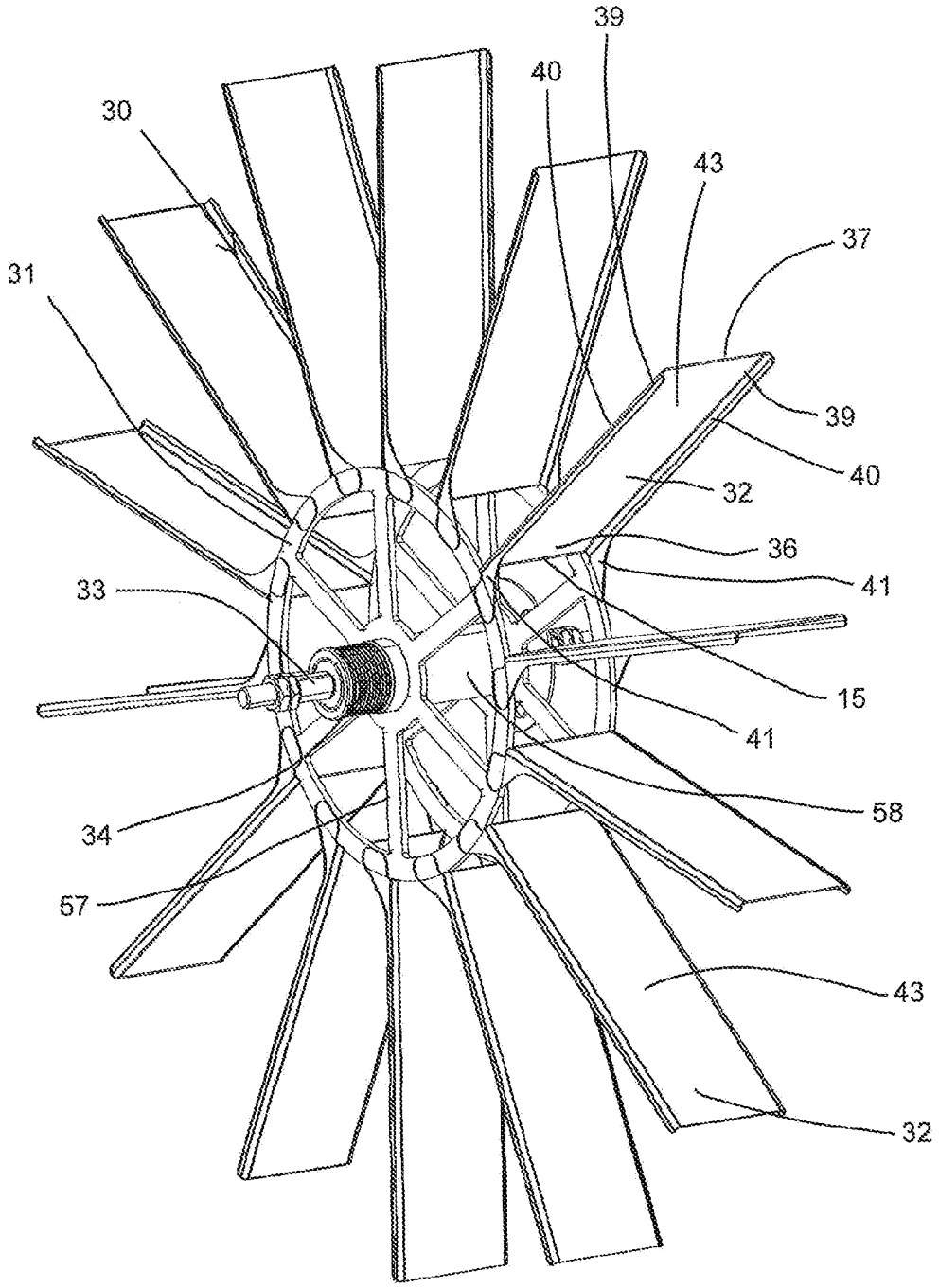
FIG. 17 is a top front perspective view of a rotor of the exercise bike of FIG. 11.

Each of the moveable baffles 120 has a body 121 rotatably mounted within the rotor chamber 13, with a plurality of moveable passages 122 defined therethrough and moveable blockers 123 positioned between the passages 122 to limit the sizes of the passages 122. The body 121 of each moveable baffle 120 may be disc-shaped and/or may have a substantially circular outer profile in one embodiment. In the embodiment of FIGS. 1-10, the moveable baffles 120 are mounted by engaging a circular mounting plate 124 that may also support the axle 33 of the rotor 30, as well as retaining posts 125 (FIG. 9A) connected to the inner surface of the rotor cover 18 and engaging the outer periphery of the moveable baffle 120. The mounting plate 124 and the retaining posts 125 each have a retaining part 126 (a lip and a projection, respectively) to hold the moveable baffle 120 between the retaining part 126 and the rotor cover 18. The variable resistance assembly 110 has a connector 127 that is connected to both moveable baffles 120 and extend across the rotor chamber 13 to ensure that both moveable baffles 120 move in unison. The connector 127 shown in FIGS. 9A and 10 is an arched member that arches radially outward between the moveable baffles 120 to avoid interfering with the movement of the rotor 30. As noted above, FIGS. 1-10 illustrate only a single moveable baffle 120, but the variable resistance assembly 110 includes a connector 127 configured to connect to the second moveable baffle 120, as in the embodiment of FIG. 16. Additionally, the moveable baffle 120 has a gap 132 in the profile, or alternately may be formed of multiple pieces, to facilitate removal or installation of the moveable baffle 120. The connector 127 may be configured to bridge the gap 132 and connect to the moveable baffle 120 on both sides of the gap 132, as shown in FIG. 10.

In this configuration, the moveable baffle 120 can be rotated between a plurality of different positions to alter the airflow through the rotor chamber 13 and thereby alter the resistance of the rotor 30. The positions include a first position, where the passages 122 of the moveable baffle 120 is relatively aligned with the passages 112 of the fixed baffle 111 and airflow through the rotor chamber 13 is maximized, and a second position, where the blockers 123 of the moveable baffle 120 are relatively aligned with the passages 112 of the fixed baffle 111, and the airflow through the rotor chamber 13 is minimized. In the first position, where airflow is maximized, the resistance is also maximized due to increased air resistance, and in the second position, where airflow is minimized, the resistance is also minimized, due to a lack of air resistance. It is understood that during the movement of the moveable baffle 120, the blockers 123 of the moveable baffle 120 may incrementally cover or uncover different portions of the passages 112 of the fixed baffle when moving between the first and second positions, gradually decreasing or increasing resistance of the rotor 30. The passages 112, 122 of the fixed and moveable baffles 111, 120 are generally trapezoid-shaped in the embodiment of FIGS. 1-10, having narrower widths near the inner periphery (i.e., nearer to the axle 33 of the rotor 30) and greater widths near the outer periphery. The blockers 114, 123 of the fixed and moveable baffles 111, 120 are also generally trapezoid-shaped in this embodiment, and are shaped similarly to the passages 112, 122. In one embodiment, at least some of the blockers 114, 123 and the adjacent passages 112, 122 are approximately the same sizes.

Further, the variable resistance assembly 110 includes an actuator 128 configured to be manipulated by the user to move the moveable baffle(s) 120. In one embodiment, the variable resistance assembly 110 has a single actuator 128 connected to both moveable baffles 120 and configured to actuate both moveable baffles 120. The actuator 128 in the embodiment of FIGS. 1-10 is shown in greater detail in FIGS. 8 and 10. In this embodiment, the actuator 128 includes a handle 129 positioned outside the rotor cover 18, with two legs 130 extending from the handle 129 through the rotor cover 18 to connect to the two moveable baffles 120. The handle 129 extends across the width of the rotor 30 and across the width of the upper rear opening 106, and the legs 130 connect to the two moveable baffles 120 on opposite sides of the rotor 30. In an embodiment with an air shield 90 as shown in FIGS. 1-10, the handle 129 also extends across the track 91 and the path of travel of the air shield 90. The handle 129 arches upward and/or radially outward, to permit sufficient space for a user's hand to pass beneath the handle 129. The rotor cover 18 has two slots 131 extending through the two pieces of the upper rear part 101, and the legs 130 of the actuator 128 extend through the slots 131 to connect to the moveable baffles 120. In this embodiment, the slots 131 are located on opposite sides of the upper rear opening 106 and opposite sides of the middle portion 116. The slots 131 have arcuate shapes following the outer periphery of the rotor cover 18 and may define the range of motion of the actuator 128 and thereby define the range of motion of the moveable baffles 120. In another embodiment, the variable resistance assembly 110 may include one or more designed stops (not shown) to engage the actuator 128 and/or the moveable baffles 120 and define the range of motion thereof. In the embodiment of FIGS. 1-10, the shapes of the fixed and moveable baffles 111, 120 and the ranges of motion of the moveable baffles 120 are designed such that the minimum resistance of the rotor 30 (i.e., maximum airflow obstruction) is achieved when the actuator 128 is at the bottom of its range of motion and the maximum resistance (i.e., minimum airflow obstruction) is achieved when the actuator 128 is at the top of its range of motion. The resistance of the rotor 30 in this configuration incrementally and steadily increases (i.e., the airflow obstruction decreases) as the actuator 128 is moved from the bottom to the top of its range of motion.

FIGS. 11-19 illustrate another embodiment of the bike 10 that is structurally and functionally similar to the bike 10 of FIGS. 1-10 in most aspects. The bike 10 in FIGS. 11-19 will therefore be described only with respect to the significant differences from the bike 10 in FIGS. 1-10, for the sake of brevity. Similar reference numbers may be used to reference components in FIGS. 11-19 as used in connection with FIGS. 1-10, including to identify components of the embodiment of FIGS. 11-19 not described directly with respect to FIGS. 11-19. Any of the features, components, and configurations described herein with respect to FIGS. 11-19 may be used in connection with other embodiments described herein, including the embodiment of FIGS. 1-10, and vice versa. It is understood that any components and features described herein with respect to FIGS. 1-10 are considered to be present in the embodiment of FIGS. 11-19, and vice versa, unless specified otherwise.

The blades 32 in the embodiment of FIGS. 11-19 differ from the blades 32 in the embodiment of FIGS. 1-10 in several respects. For example, the blades 32 are flat from the proximal end 36 to the distal end 37 in the embodiment of FIGS. 11-19, and do not have a curved second section as in the embodiment of FIGS. 1-10. The blades 32 of this embodiment are briefly described herein. In the embodiment of FIGS. 11-19, the blades 32 have flanges 39 extending outwardly from the bottom major surface 43 of the blade 32, such that the blade 32 has a substantial U-shape or C-shape in cross-section. The flanges 39 in the embodiment of FIGS. 11-19 are similar in structure to the flanges 39 in FIGS. 1-10 and are not described again in great detail. The flanges 39 in FIGS. 11-19 extend the entire length of the body of the blade 32, from the proximal end 36 to the distal end 37, but may extend less than the entire length in other embodiments. Further, each blade 32 in the embodiment of FIGS. 11-19 has substantially flat top and bottom major surfaces 43 and has a width (between the edges 40) that is constant from the proximal end 36 to the distal end 37. The flanges 39 in this embodiment are positioned at an angle with the top and bottom major surfaces 43 that is approximately 90°.

The blades 32 in FIGS. 11-19 also have mounts 41 extending outward from the blade 32 at the proximal end 36 to provide a mounting structure for connection to the hub 31, similar to the blades 32 in FIGS. 1-10. The mounts 41 extend from the proximal end 36 on both sides 40 of the blade 32 in the embodiment of FIGS. 11-19, and each mount 41 has an opening 42 to receive the fasteners 35 for connection to the hub 31. Each blade 32 has a proximal edge 15 that extends between the mounts 41 in this embodiment. The fasteners 35 in this embodiment extend through the openings 42 in the mounts 41 and are connected to opposed side surfaces of the hub 31, such as by being received in openings (not shown), which may be threaded. In the embodiment of FIGS. 11-19, the blades 32 are all connected and supported only at the mounts 41 at the proximal ends 36, and no other structures engage the blades 32 between the proximal and distal ends 36, 37.

The bike 10 in FIGS. 11-19 has an air shield 90 and a variable resistance assembly 110 that are generally similar in structure and function to the embodiment of FIGS. 1-10. As described above, the variable resistance assembly 110 in FIGS. 11-19 has two fixed baffles 111 on opposite sides of the rotor 30 and two moveable baffles 120 also on opposite sides of the rotor 30 and located adjacent to the fixed baffles 111. The moveable baffles 120 in this embodiment may be moveably mounted in place and connected to the rotor cover 18 in a manner similar to that described herein with respect to the moveable baffle 120 in FIGS. 1-10. The configuration of FIGS. 11-19, with two moveable baffles 120 and two fixed baffles 111 may be incorporated into the embodiment of FIGS. 1-10. Likewise, the embodiment of FIGS. 11-19 may be modified to include only a single moveable baffle 120. The variable resistance assembly 110 in FIGS. 11-19 also includes an actuator 128 and a connector 127 configured similar or identical to those described herein with respect to the embodiment of FIGS. 1-10.

Figure 18:
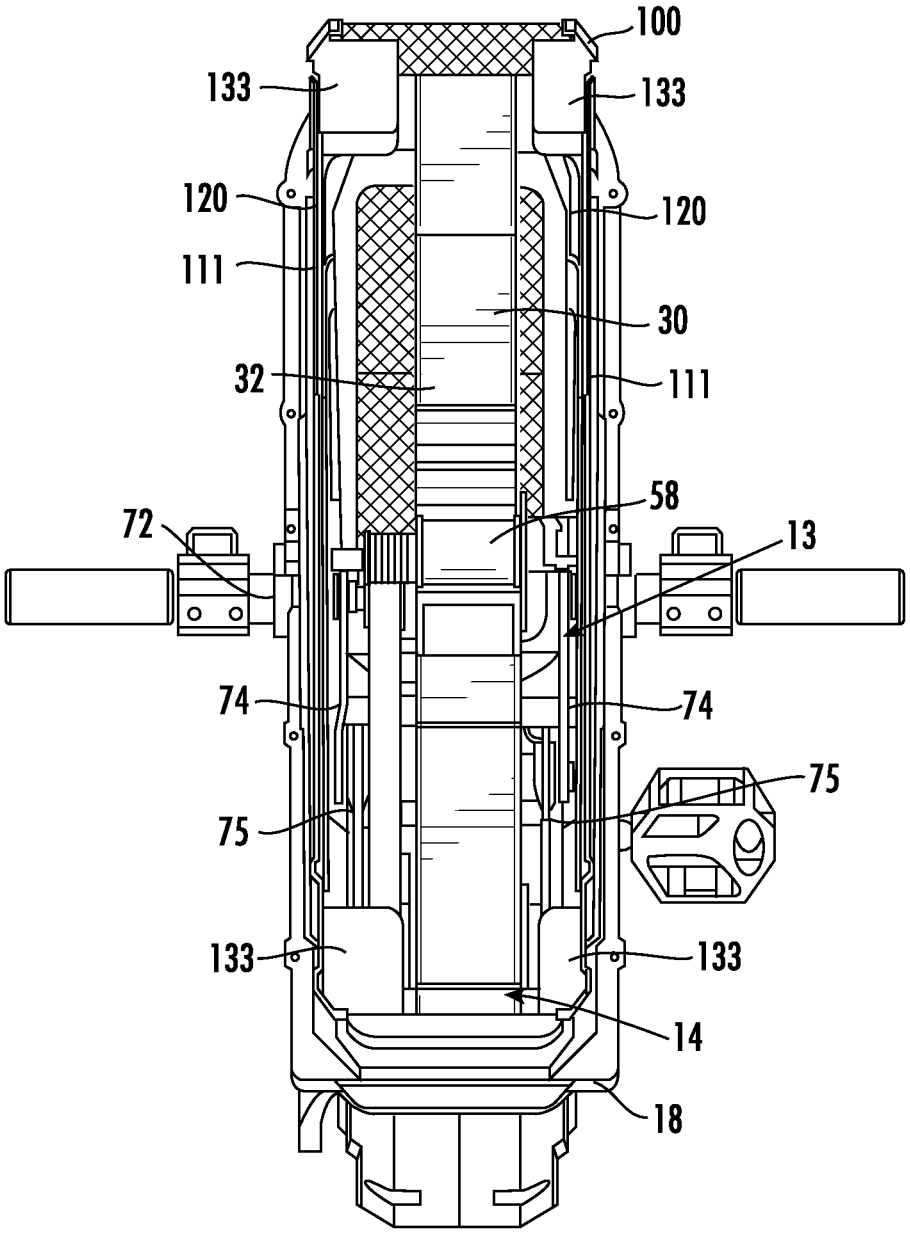
FIG. 18 is a front cross-sectional view of a portion of the exercise bike of FIG. 11.
Figure 19:
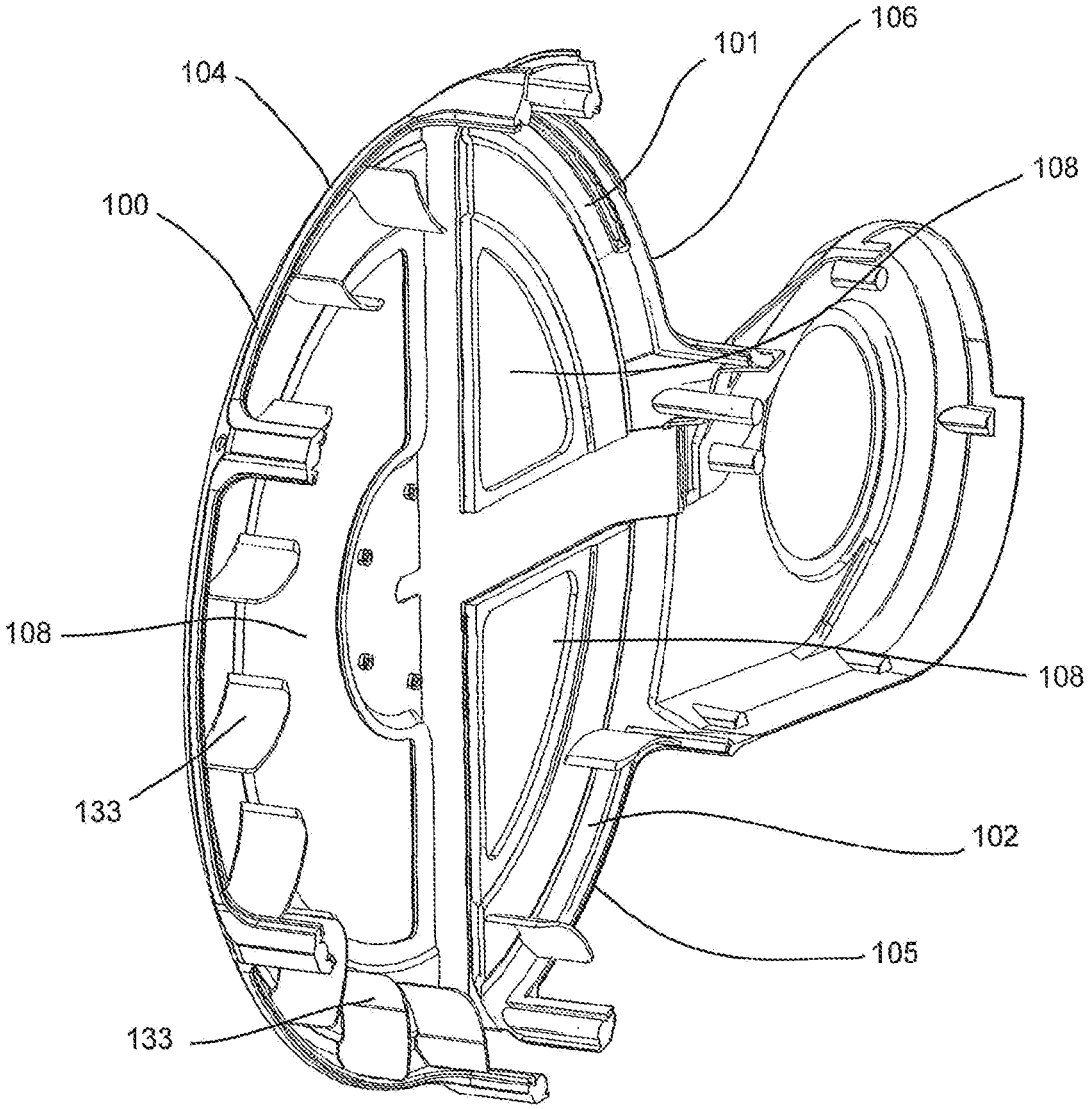
FIG. 19 is top front perspective view of a portion of a rotor casing of the exercise bike of FIG. 11.

The rotor assembly 14 in the embodiment of FIGS. 11-19 includes a plurality of fins 133 extending into the rotor chamber 13 and positioned around at least a portion of an inner periphery of the rotor cover 18. As shown in FIGS. 18-19, the fins 133 are connected to the inner surface of the rotor cover 18 around at least the front and bottom of the rotor cover 18 and project both radially inward into the rotor chamber 13 and axially into the rotor chamber 13 to extend within the peripheries of at least some of the openings 104, 105, 106 of the rotor cover 18. In the embodiment illustrated in FIG. 18, the fins 133 extend into the peripheries of all three of the front openings 104 and the lower rear opening 105 of the rotor cover 18. The fins 133 are connected to the rotor cover 18 at the corners 134 of the rotor cover 18 and extend outward from the corners 134 in this manner. Additionally, each of the fins 133 is curved to extend both radially inward and rearward against the direction of travel of the rotor blades 32 during operation of the bike 10. The fins 133 on opposite sides of the rotor cover 18 extend outwardly a sufficient distance to overlap radially with the path of the rotor 30 and are spaced from each other axially (with respect to the rotor 30) to provide space for the blades 32 to pass, as shown in FIG. 18. In the configuration illustrated, the rotor 30 is not centered axially within the rotor cover 18, and the fins 133 on opposite sides of the rotor chamber 13 have different widths to provide a space that is aligned with the path of the rotor 30. The fins 133 create increased turbulence within the rotor chamber 13 as the rotor 30 spins, particularly at higher RPM, which increases resistance to rotation of the rotor 30. The lengths, orientations, and contours of the fins 133 can be designed to achieve a specific amount of turbulence for a desired resistance profile. The fins 133 can be integrally molded with the pieces of the rotor cover 18 in one embodiment, or may be fixed in place, such as by integral joining techniques (e.g., welding), adhesives, fasteners, mechanical interlock, etc.

The bikes 10 in FIGS. 1-10 and 11-18 further have a device holder 99 configured to removably hold a mobile device, such as a phone or tablet, in an easily visible and accessible position for the user. The device holder 99 may also be configured to hold a permanent device, such as a dedicated computer device configured to read and analyze data from various sensors connected to the bike 10 and/or to provide output in user-readable form, e.g., including the interface 19.

Various embodiments of exercise bikes have been described herein, which include various components and features. In other embodiments, the exercise bikes may be provided with any combination of such components and features. It is also understood that in other embodiments, the various devices, components, and features of the exercise bikes described herein may be constructed with similar structural and functional elements having different configurations, including different ornamental appearances.

The various embodiments of an exercise bike 10 shown and described herein provide advantages over existing exercise bikes and other exercise equipment. The bike 10 has a heavy-duty construction, with greater rigidity and weight in the components of the rotor assembly 14 and the drive assembly 16 as compared to other exercise bikes. For example, the blades 32 of the rotor assembly 14 have greater weight and structures to increase the rigidity and bending stiffness of the blades 32, which creates better feel, less vibration and noise, and more consistent effort throughout the exercise stroke. As another example, the variable resistance assembly provides a great degree of control over resistance of the bike, as well as consistent effort experienced by the user. As a further example, the wind shield provides the option for the user to select whether air from the rotor 30 will blow into their face or whether they want shield their face from the blown air. As yet another example, the curved blades 32 and/or the curved fins 133 provide for increased turbulence in the chamber, producing greater and more consistent effort. Still other benefits and advantages are recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three-dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. The term "about," as used herein, indicates a variance of +/−10% from the nominal value stated. For quantitative values described herein that do not include decimal points, each digit to the left of the decimal point is considered to be a significant digit. Accordingly, while the specific embodiments have been illustrated and described, numerous modifications come to mind without significantly departing from the spirit of the invention and the scope of protection is only limited by the scope of the accompanying claims.

What is claimed is:

1. An exercise bike comprising:

a frame configured to rest on a ground surface;

a pedal assembly mounted on the frame;

a rotor mounted on the frame and configured for rotation about a rotation axis, the rotor operably connected to the pedal assembly to power rotation of the rotor, wherein the rotor comprises a hub with a plurality of fan blades extending radially outward from the hub;

a rotor cover mounted on the frame and at least partially enclosing the rotor, the rotor cover having a first side portion and a second side portion on an opposite side of the rotor from the first side portion, and a middle portion extending between the first and second side portions and circumferentially around at least a portion of the rotor, the first side portion having a first opening, and wherein the rotor cover further has a first slot and a second slot extending around a portion of the rotor cover on opposite sides of the middle portion;

a variable resistance assembly including a first moveable baffle that is moveable to selectively restrict air passage through the first opening; and an actuator connected to the first moveable baffle and comprising a handle configured for gripping by a user to move the first moveable baffle, and a first leg and a second leg extending into the first slot and the second slot, respectively, such that the first leg extends through the rotor cover via the first slot and connects to the first moveable baffle, wherein the handle extends across the middle portion, and the first and second legs are on opposite sides of the rotor, and wherein the actuator is moveable by the first leg and the second leg traveling along the first slot and the second slot, respectively.

2. The exercise bike of claim 1, wherein the rotor has a width measured across the fan blades parallel to the rotation axis, and wherein the actuator extends completely across the width of the rotor.

3. The exercise bike of claim 2, wherein the second side portion has a second opening, and the variable resistance assembly includes a second moveable baffle on an opposite side of the rotor as the first moveable baffle, and wherein the second moveable baffle is moveable to selectively restrict air passage through the second opening.

4. The exercise bike of claim 1, wherein the variable resistance assembly includes a first fixed baffle positioned adjacent to the first moveable baffle and the first opening, wherein the first fixed baffle has a plurality of first air passages, and the first moveable baffle is moveable and configured to cover a selectable portion of the plurality of first air passages to control airflow through the first air passages, thereby selectively restricting air passage through the first opening.

5. The exercise bike of claim 4, wherein the second side portion has a second opening, and the variable resistance assembly includes a second moveable baffle on an opposite side of the rotor as the first moveable baffle, and a second fixed baffle positioned adjacent to the second moveable baffle and the second opening, wherein the second fixed baffle has a plurality of second air passages, and the second moveable baffle is moveable and configured to cover a selectable portion of the plurality of second air passages to control airflow through the second air passages, thereby selectively restricting air passage through the second opening.

6. The exercise bike of claim 1, wherein the first moveable baffle has a disc-shaped body with a substantially circular outer profile and a plurality of first air passages, with a gap extending from the outer profile to one of the first air passages, and wherein the first leg of the actuator is connected to the body of the first moveable baffle on both sides of the gap and extends across the gap.

7. The exercise bike of claim 1, wherein the rotor cover has an upper rear opening in the middle portion, and the first and second slots are on opposite sides of the upper rear opening, such that the handle of the actuator extends across the upper rear opening.

8. The exercise bike of claim 7, further comprising an air shield connected to the rotor cover and configured for selectively covering a portion of the upper rear opening to control a flow of air displaced by the rotor through the upper rear opening.

9. The exercise bike of claim 8, wherein the air shield is moveably connected to the rotor cover and is moveable between a plurality of positions relative to the upper rear opening to selectively cover a plurality of portions of the upper rear opening to control the flow of air displaced by the rotor through the upper rear opening.

10. A rotor for an exercise bike, comprising:

a hub configured to be rotatably mounted on the exercise bike;

a plurality of blades fixed to the hub at a proximal end and extending outward from the hub to a distal end, wherein each of the plurality of blades has first major surface configured to be a trailing surface in a direction of travel of the blade and a second major surface opposite the first major surface and configured to be a leading surface in a direction of travel of the blade, wherein each of the plurality of blades comprises:

a first section extending along a longitudinal direction from the proximal end toward the distal end, wherein the first section has a central portion that is elongated along the longitudinal direction and has a flat profile, such that the first and second major surfaces are flat at the central portion;

a second section extending from the first section to the distal end, wherein the second section has a curved profile along the longitudinal direction, such that the first major surface has a convexly curved profile and the second major surface has a concavely curved profile; and a mount connected to the first section and fixed to the hub;

wherein the first section of each of the blades further has an outer portion that is elongated along the longitudinal direction and offset from the central portion in a direction perpendicular to the longitudinal direction, and a step portion extending from the central portion to the outer portion, such that the outer portion extends from the step portion to a first outer edge of the blade, and the step portion forms angles with the central portion and the outer portion; and wherein the central portion, the outer portion, and the step portion extend continuously from the first section through the second section to the distal end of each of the blades.

11. The rotor of claim 10, wherein each of the blades further has a flange extending along the longitudinal direction and extending transverse to the first and second major surfaces along an outer edge of the blade.

12. The rotor of claim 11, wherein the flange of each of the blades extends along the outer edge in the first section and terminates short of the second section.

13. The rotor of claim 10, wherein the first section of each of the blades further has a second outer portion that is elongated along the longitudinal direction and offset from the central portion in the direction perpendicular to the longitudinal direction, and a second step portion extending from the central portion to the second outer portion, such that the second outer portion extends from the second step portion to a second outer edge of the blade opposite the first outer edge, and the second step portion forms angles with the central portion and the second outer portion.

14. The rotor of claim 13, wherein the central portion, the outer portion, the second outer portion, the step portion, and the second step portion extend continuously from the first section through the second section to the distal end of each of the blades.

15. An exercise bike comprising:

a frame configured to rest on a ground surface;

a pedal assembly mounted on the frame;

a rotor mounted on the frame and configured for rotation about a rotation axis, the rotor operably connected to the pedal assembly to power rotation of the rotor, wherein the rotor comprises a hub with a plurality of fan blades extending radially outward from the hub;

a rotor cover mounted on the frame and at least partially enclosing the rotor within a chamber defined by the rotor cover, the rotor cover having a first side portion and a second side portion on an opposite side of the rotor from the first side portion, a middle portion extending between the first and second side portions and circumferentially around at least a portion of the rotor, and an upper rear opening to the chamber located in the middle portion;

an air shield connected to an outer side of the rotor cover and positioned outside the chamber, the air shield configured for selectively covering a portion of the upper rear opening to control a flow of air displaced by the rotor through the upper rear opening.

16. The exercise bike of claim 15, wherein the air shield is removably connected to the rotor cover and is configured for selectively covering the portion of the upper rear opening when connected to the rotor cover.

17. The exercise bike of claim 16, wherein the rotor cover has a receptacle located adjacent to the upper rear opening, and the air shield is received in the receptacle when removably connected to the rotor cover.

18. The exercise bike of claim 16, wherein the rotor cover and the air shield have complementary magnetic elements to removably connect the air shield to the rotor cover.

19. The exercise bike of claim 15, wherein the air shield is moveably connected to the rotor cover and is moveable between a plurality of positions relative to the upper rear opening to selectively cover a plurality of portions of the upper rear opening to control the flow of air displaced by the rotor through the upper rear opening.

20. The exercise bike of claim 19, wherein the rotor cover has first and second channels extending along opposite sides of the upper rear opening, and the air shield has first and second flanges extending outward from opposed edges of the air shield, and wherein the first flange is received in the first channel and the second flange is received in the second channel, such that the air shield is configured to be moveable by the first and second flanges traveling along the first and second channels.

21. The exercise bike of claim 19, wherein the air shield is moveable along a path between the plurality of positions, and the rotor cover has a first opening in the first side portion, and the exercise bike further comprises:

a variable resistance assembly including a first moveable baffle that is moveable to selectively restrict air passage through the first opening; and an actuator connected to the first moveable baffle and comprising a handle configured for gripping by a user to move the first moveable baffle, wherein the handle extends across the path of the air shield.

22. The exercise bike of claim 19, wherein the air shield has a body moveably connected to the rotor cover along opposed edges thereof, and wherein the body is arched circumferentially with respect to the rotor and also arched transverse to a movement path of the air shield.

23. The exercise bike of any of claim 15, wherein the rotor cover further comprises a screen covering the upper rear opening while permitting passage of air therethrough, and wherein the air shield is positioned outside of the screen and adjacent to an outer surface of the screen.

24. An exercise bike comprising:

a frame configured to rest on a ground surface;

a pedal assembly mounted on the frame;

a rotor mounted on the frame and configured for rotation about a rotation axis, the rotor operably connected to the pedal assembly to power rotation of the rotor, wherein the rotor comprises a hub with a plurality of fan blades extending radially outward from the hub;

a rotor cover mounted on the frame and at least partially enclosing the rotor, the rotor cover having a first opening on a first side of the rotor cover and a second opening on a second side of the rotor cover opposite the first side;

a variable resistance assembly comprising:

a first fixed baffle positioned adjacent to the first opening, wherein the first fixed baffle has a plurality of first air passages;

a first moveable baffle that is moveable to cover a selectable portion of the plurality of first air passages to control airflow through the first air passages, thereby selectively restricting air passage through the first opening, wherein the first moveable baffle has a first disc-shaped body with a substantially circular outer profile, with a first gap extending from the outer profile to one of the first air passages;

a second fixed baffle positioned adjacent to the second opening, wherein the second fixed baffle has a plurality of second air passages; and a second moveable baffle that is moveable to cover a selectable portion of the plurality of second air passages to control airflow through the second air passages, thereby selectively restricting air passage through the second opening, wherein the second moveable baffle has a second disc-shaped body with a substantially circular outer profile, with a second gap extending from the outer profile to one of the second air passages; and an actuator connected to the first moveable baffle and the second moveable baffle and configured for manipulation by a user to move the first and second moveable baffles, wherein the actuator is connected to the first moveable baffle on both sides of the first gap and extends across the first gap, and the actuator is connected to the second moveable baffle on both sides of the second gap and extends across the second gap.

25. The exercise bike of claim 24, wherein the rotor cover has a first slot and a second slot extending through the rotor cover, and wherein the actuator comprises a handle configured for gripping by the user, a first leg extending from the handle through the first slot to connect to the first moveable baffle, and a second leg extending from the handle through the second slot to connect to the second moveable baffle.

26. The exercise bike of claim 25, wherein the rotor cover has a first side portion and a second side portion on an opposite side of the rotor from the first side portion, and a middle portion extending between the first and second side portions and circumferentially around at least a portion of the rotor, the first side portion having a first opening, and wherein the first slot and the second slot extend around a portion of the rotor cover on opposite sides of the middle portion.

27. The exercise bike of claim 25, wherein the rotor cover has an upper rear opening located between the first slot and the second slot, and the handle of the actuator extends across the upper rear opening.

28. The exercise bike of claim 24, wherein the first moveable baffle has a plurality of first moveable baffle air passages and a plurality of first blockers located between the plurality of first moveable baffle air passages, and the second moveable baffle has a plurality of second moveable baffle air passages and a plurality of second blockers located between the plurality of second moveable baffle air passages, wherein the first moveable baffle air passages and the second moveable baffle air passages have widths that are narrower near an inner periphery and greater near an outer periphery of the first moveable baffle and the second moveable baffle, respectively.

* * * * *